US008834287B1

(12) United States Patent
Reid

(10) Patent No.: US 8,834,287 B1
(45) Date of Patent: Sep. 16, 2014

(54) GOLF SWING TRAINING DEVICE FOR IMPROVING SET UP AND SWING PLANE OF A GOLF SWING

(71) Applicant: Worrell A. Reid, Centerville, OH (US)

(72) Inventor: Worrell A. Reid, Centerville, OH (US)

(73) Assignee: W. Reid, Centerville, OH (US), Trustee U/A ( * ) Notice: Subject to any disclaimer, the term of this patent is extended or adjusted under 35 U.S.C. 154(b) by 0 days.

(21) Appl. No.: 13/783,045

(22) Filed: Mar. 1, 2013

(51) Int. Cl.
*A63B 69/36* (2006.01)

(52) U.S. Cl.
CPC ..... *A63B 69/3667* (2013.01)
USPC ..... 473/266; 473/218; 473/272

(58) Field of Classification Search
USPC ..... 473/218, 252, 257, 266, 269, 270, 272, 473/273, 409
See application file for complete search history.

(56) References Cited

U.S. PATENT DOCUMENTS

| | | | | | |
|---|---|---|---|---|---|
| 2,169,407 | A | * | 8/1939 | Crowley | 473/272 |
| 2,457,351 | A | * | 12/1948 | Crowley | 473/272 |
| 3,815,923 | A | | 6/1974 | Goduto | |
| 4,257,608 | A | | 3/1981 | Funk | |
| 4,384,718 | A | * | 5/1983 | Cachola | 473/218 |
| 4,521,023 | A | | 6/1985 | Williams | |
| 4,569,525 | A | | 2/1986 | Folger | |
| 4,688,800 | A | | 8/1987 | Lopez | |
| 4,817,953 | A | | 4/1989 | Ponchak | |
| 4,883,276 | A | | 11/1989 | Brown | |
| 5,362,060 | A | * | 11/1994 | Hinson | 473/218 |
| 5,390,929 | A | | 2/1995 | Todaro | |
| 5,435,727 | A | * | 7/1995 | Dobson | 434/252 |
| 5,482,284 | A | * | 1/1996 | Vandever | 473/218 |
| 5,616,085 | A | | 4/1997 | LaCoste | |
| 5,692,965 | A | | 12/1997 | Nighan et al. | |
| 6,007,341 | A | | 12/1999 | Koch | |
| 6,024,656 | A | | 2/2000 | Lane | |
| 6,059,668 | A | * | 5/2000 | Marley, Jr. | 473/220 |
| 6,077,168 | A | * | 6/2000 | Huang | 473/218 |
| 6,106,408 | A | * | 8/2000 | Roman | 473/266 |
| 6,440,004 | B1 | | 8/2002 | Rodriguez | |
| 6,500,075 | B1 | | 12/2002 | McDevitt | |
| 6,726,576 | B1 | | 4/2004 | Froggatte | |
| 6,988,957 | B2 | | 1/2006 | Bender | |
| 7,037,210 | B2 | * | 5/2006 | Bainter | 473/270 |
| 7,150,683 | B2 | | 12/2006 | Bender | |
| 7,226,371 | B2 | | 6/2007 | Leadbetter et al. | |
| 7,448,956 | B2 | | 11/2008 | Mitchell | |
| 7,491,132 | B2 | | 2/2009 | Bush, III et al. | |
| 7,566,278 | B2 | | 7/2009 | Jackson | |

(Continued)

OTHER PUBLICATIONS

Ben Hogan, Five Lessons The Modern Fundamentals of Golf, First Fireside Edition, Simon & Schuster, 1957, 3 pages.

(Continued)

*Primary Examiner* — Nini Legesse
(74) *Attorney, Agent, or Firm* — Hahn Loeser & Parks LLP

(57) ABSTRACT

The present invention is a golf swing training aid having a takeaway bar, a spine angle alignment guide, a position "A" bar, and a hands placement guide. The takeaway bar may be connected adjacent an end of the spine alignment guide. The apparatus is adjustable, and is suitable for practicing with every club in the bag, from the driver to the putter to improve distance and consistency. The apparatus may be used on the ground or a mat at a driving range.

15 Claims, 27 Drawing Sheets

(56) References Cited

U.S. PATENT DOCUMENTS

| | | | | |
|---|---|---|---|---|
| 7,798,910 | B2 | 9/2010 | Leadbetter et al. | |
| 7,901,295 | B1 | 3/2011 | Bush, III | |
| 7,976,399 | B1 | 7/2011 | Pritchett | |
| 7,980,958 | B1 | 7/2011 | Ford | |
| 8,100,778 | B2 * | 1/2012 | Willis | 473/218 |
| 8,246,482 | B1 * | 8/2012 | Kim | 473/272 |

OTHER PUBLICATIONS

Athena Collins, How to Hit a Draw and a Fade, Aug. 30, 2010, 3 pages, downloaded from http://www.examiner.com/article/how-to-hit-a-draw-and-a-fade on Dec. 6, 2013.

* cited by examiner

GOLF SWING TRAINING DEVICE FOR IMPROVING SET UP AND SWING PLANE OF A GOLF SWING

This is an original application for a patent relating to a golf swing training device for improving aspects of a golfer's swing, including set up and swing plane.

BACKGROUND

1. Field of the Invention

The present invention was inspired by the golf swing of the legendary golfer, Ben Hogan. The apparatus was designed to provide a framework for better understanding the mechanics of the golf swing, and to thus enable the user to build a better swing.

2. Description of the Related Art

A golf swing is very complicated, due in part to the number of functions that must be properly performed, both before and during the swing. The present invention uses the swing of Ben Hogan as a paradigm, and sets out to demonstrate the alignment, set up, posture, takeaway, pivot, position at the top, reverse pivot, impact, and follow through of a golf swing. With some practice using the apparatus, it will become easier for the golfer to identity how to improve his or her swing, and to learn how to build a sound, dependable golf swing.

Prior golf swing training devices focus on either the set up, the swing plane, or some part thereof. Typical examples include U.S. Pat. No. 6,007,341 to Koch, which is similar to the Medicus® swing trainer. The Medicus® swing trainer is a golf club having hinges that break if the shaft does not move along the proper plane. The major problem with this and other devices having breakable hinges is that they ignore the set up and positioning of the hands and arms at address and other critical stages of the swing. This makes it difficult for the user to swing on the same plane time after time, and is further frustrating as the ball may not be struck providing no feedback to the user.

U.S. Pat. No. 6,726,576 to Froggatte discloses a device that has means for placing the ball in the stance, but is based on the theory that the ball should be placed to the right or left depending on the club selection alone. In contrast, the present swing aid uses only one ball placement for all standard shots, adjusting the stance to suit the club being hit, not changing the ball placement to suit club selection.

Another is U.S. Pat. No. 4,521,023 to Williams. This patent relates to a device that stabilizes a golfer's head and torso, enabling him to turn back and through on a particular swing axis. This device is cumbersome and not easily movable, and does not teach a swing plane.

U.S. Pat. No. 7,150,683 to Bender provides a permanently mounted device having a plurality of movable parts that allow the golfer to practice a variety of shots. This device does not offer a pattern on the ground for a golfer to use to learn a useful swing plane, and is far too bulky and expensive to be offered as a practical solution to meet the needs of most golfers, particularly beginners.

Another is U.S. Pat. No. 5,692,965 to Nighan. This device uses a golf club equipped with a laser beam near the clubhead to help the user get a better visual understanding of the swing plane. This beam of light does not depict proper stance, set up, nor swing plane. The fact of the matter is that the hands, wrists, arms, shoulders, and hips must be in the proper position, at the proper time in the swing, to produce a successful result.

Yet another is U.S. Pat. No. 4,440,004 to Rodriquez. This device has means of establishing a golfer's stance, including width and position from the ball; however, this device does not teach means of adjusting the stance (opening and closing the stance depending on club selection), nor means of teaching a swing plane.

While all of these inventions have furthered the art of golf swing aids, none of the known prior art simultaneously addresses key aspects of the golf swing, including alignment, stance, ball placement, set up, and swing plane.

SUMMARY OF THE INVENTION

The present invention, and the concepts expressed herein, guide a user to swing a golf club as demonstrated by the golf swing described in B. Hogan, *Five Lessons The Modern Fundamentals of Golf*, First Fireside Edition, Simon & Schuster, 1957. As used herein, a golf club includes a shaft having a grip at one end for positioning a user's hands and a clubhead at the other end configured for hitting a golf ball. Typically, the length of the shaft increases for clubs adapted for hitting longer distances. The clubhead has a clubface having a desired loft. Most clubs have a number that corresponds to its loft. In general, the higher the number on the club, the higher the loft and the shorter the shaft. For example, a 9 iron will hit the ball higher and substantially shorter than a 3 iron. A longer club having a lower number and a correspondingly lower loft tends to be more difficult to hit successfully.

The swing aid comprises a takeaway bar, a spine angle alignment guide, and a position "A" bar. The present apparatus is designed to assist a user with alignment, stance, posture, set up, back swing plane, and downswing plane. In regard to alignment, the device provides symmetrical elements to assist the user in aligning the shoulders, hips, and feet in a square position in relationship to the target line. To assist with the set up, the device has a ball placement guide, a spine angle alignment guide, a hands placement guide, and stance assistant. These components help the user learn how to set up to the ball with various clubs in the bag, which in turn leads to a more consistent swing plane and better ball striking. Finally, in regard to swing plane, the apparatus has a takeaway bar and a position "A" bar. The takeaway bar teaches the user to rotate the wrists and turn the shoulders during the initial part of the backswing, and is used as a guide for shaft alignment at the end of the backswing. The position "A" bar helps with the hip pivot, and the position of the hands, left arm, and clubshaft at the top of the swing. Furthermore, the position "A" bar will assist the user in executing the downswing with the hips, and in getting the hands "in the slot," as discussed below, through the impact zone where the clubhead meets the ball. Both the takeaway bar and the position "A" bar are adjustable so that the user can set a desired set up that is suitable for hitting each club in the bag, from the driver to the putter. It is contemplated that the present apparatus may be used when hitting off the mat at a driving range, as opposed to natural turf, because this does not produce a divot, and there would be no need to move the swing aid for the next shot.

DETAILED DESCRIPTION

Figure 1:
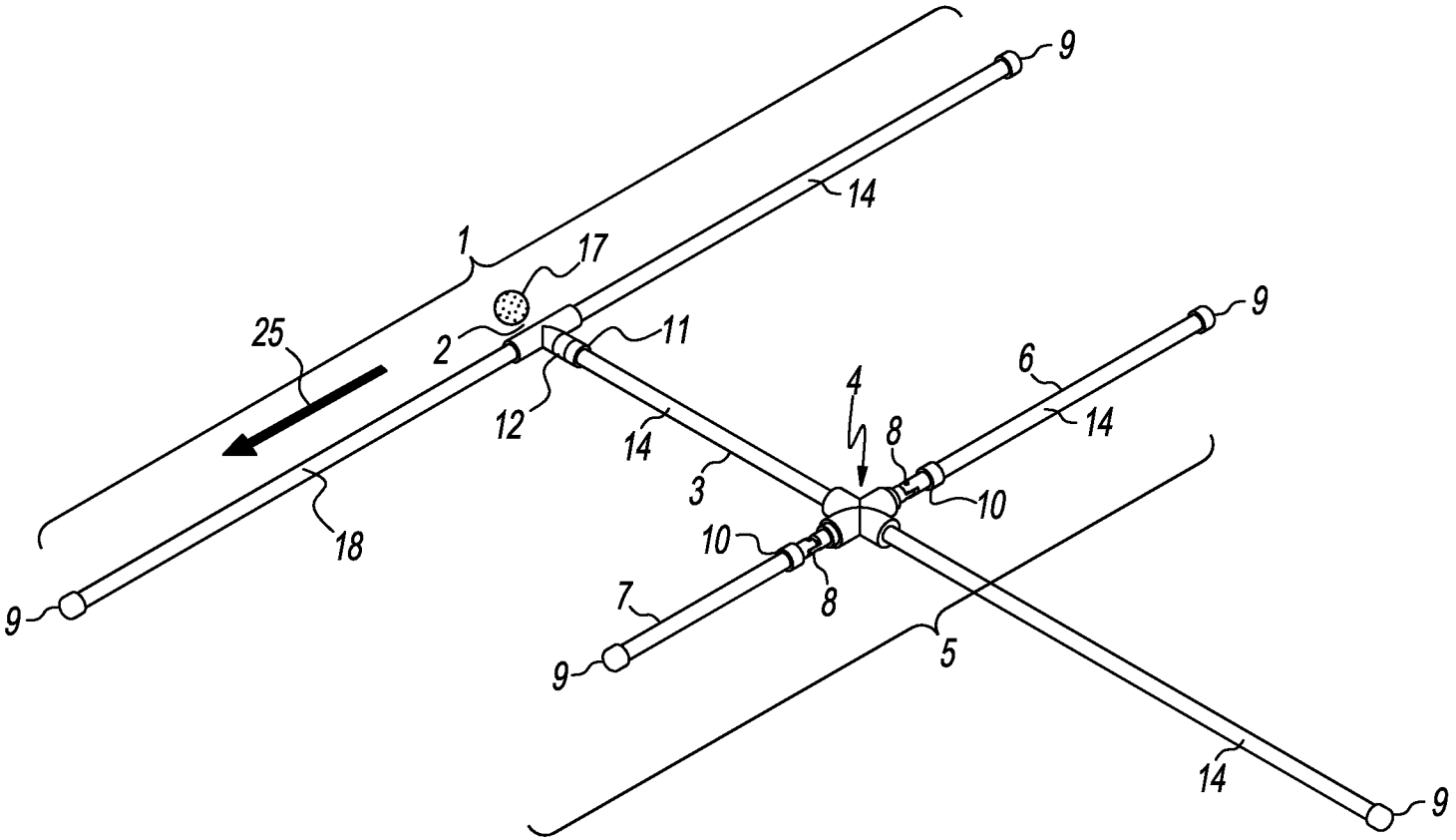
FIG. 1 is a perspective view of the golf swing aid, with the apparatus positioned for use by a right handed golfer.

A detailed description of the invention is described below. Referring to FIGS. 1, 2, 3, 4, 5, 6, 7, and 8, the invention comprises an adjustable takeaway bar (1), a spine angle alignment guide (3) attached to the takeaway bar (1), and a position "A" bar (5) movably positioned along the spine angle alignment guide (3). The takeaway bar (1) is connected transverse to the spine alignment guide and adjacent to an end of the spine alignment guide (3). In the embodiment shown in FIG. 1, the takeaway bar (1) is connected tranversely to an end of the spine angle alignment guide (3). The takeaway bar (1) has a ball placement guide (2), such that a ball (17) may be positioned in front of it, and an elongated bar member (18) positionable relative to the ball placement guide (2) as discussed below. The spine angle alignment guide (3) extends between the takeaway bar (1) and the position "A" bar (5).

Figure 2:
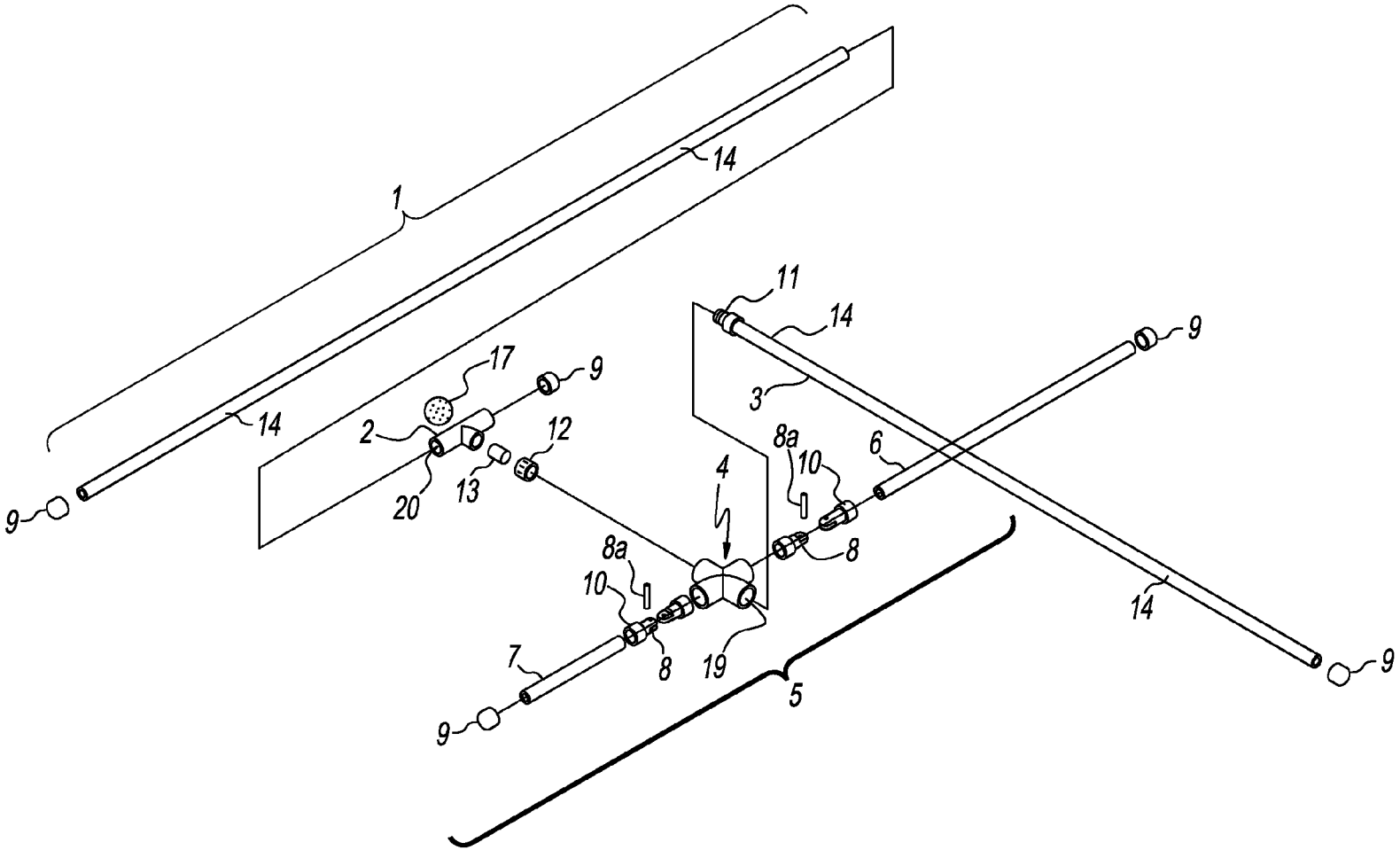
FIG. 2 is an exploded view of the golf aid.
Figure 21:
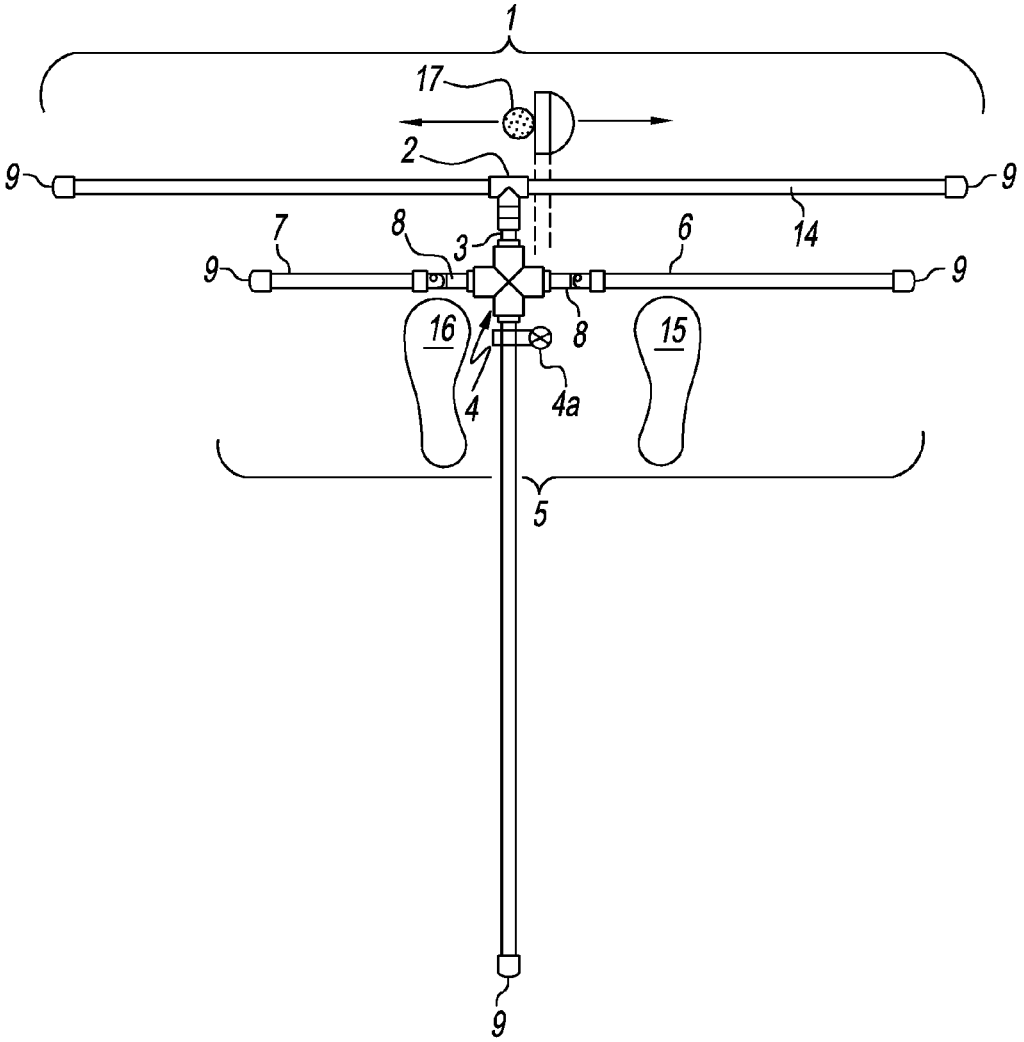
FIG. 21 is a top environmental view showing the utility of the apparatus in regard to putting, with a putting hands placement guide attached to the apparatus, and the directional movement of the clubhead during the stroke.
Figure 22A:
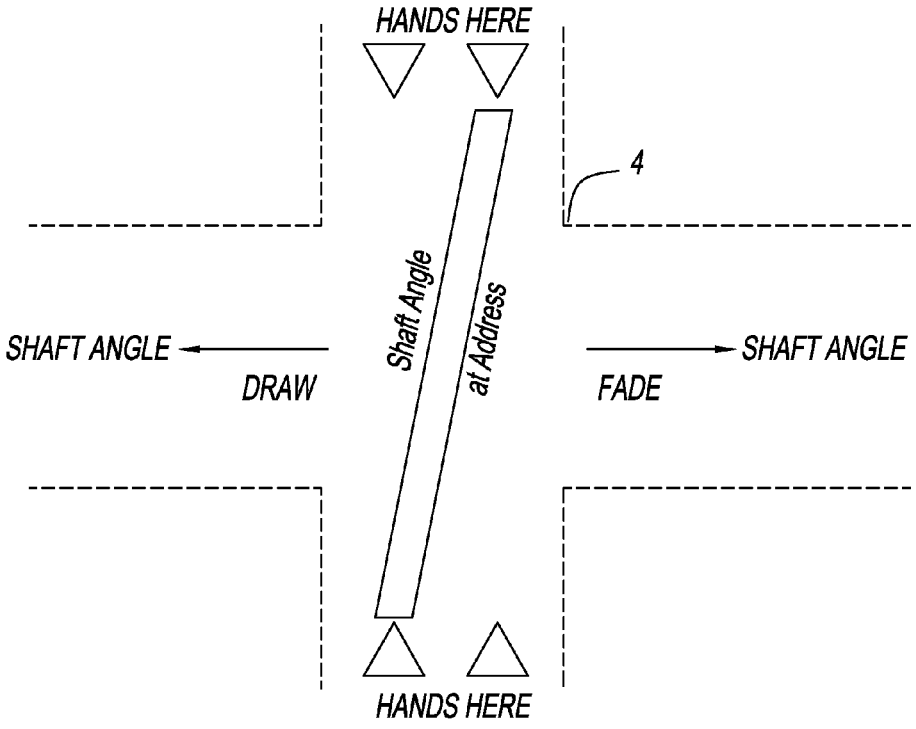
FIG. 22A is a top environmental view of the hands placement guide fitted with a decal conveying instructions in regard to various shaft angle positions, and "working the ball."
Figure 22B:
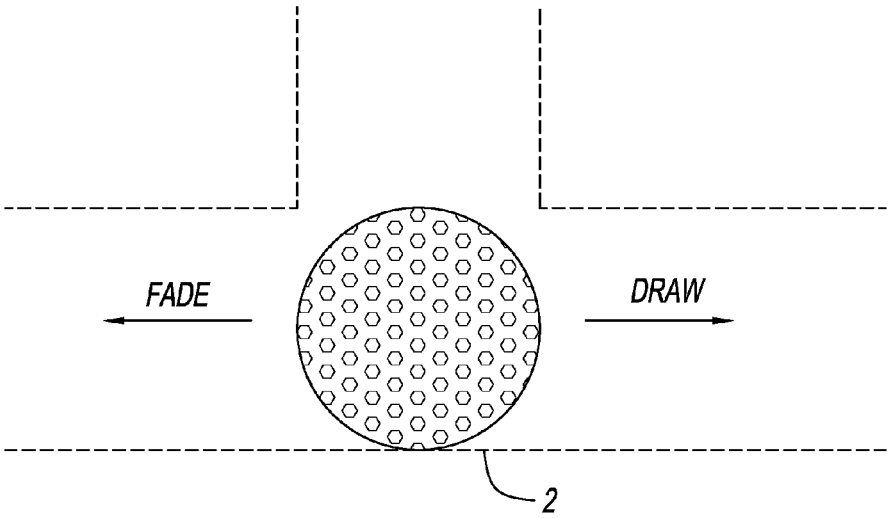
FIG. 22B is a top environmental view of the ball placement guide fitted with a decal conveying instructions in regard to various ball placement positions, and "working the ball."
Figure 23:
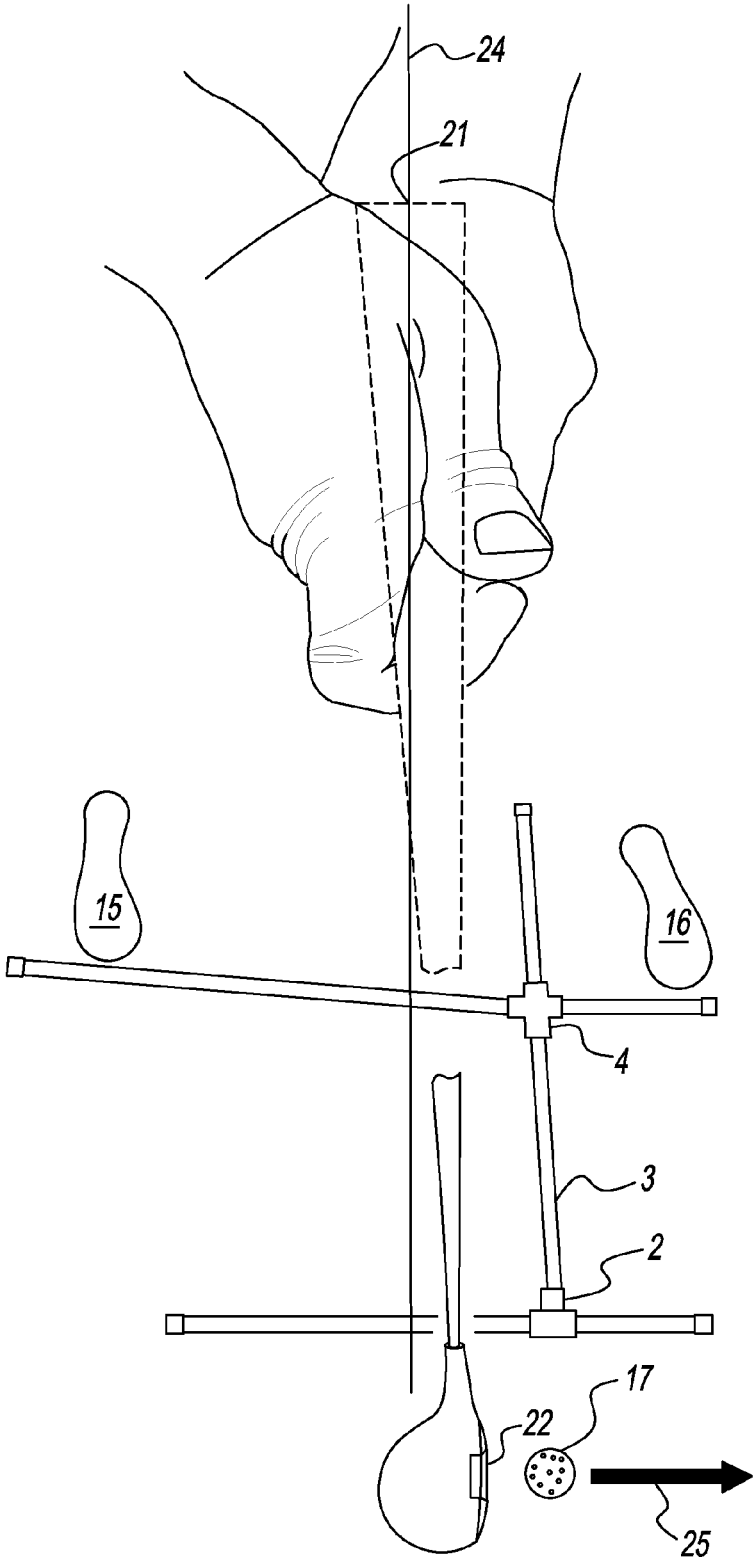
FIG. 23 is a frontal environmental view of the user gripping the club with a neutral shaft and clubface angle, and the shaft angle aligned along the swing axis, while setting up with the driver to hit the ball straight.
Figure 24:
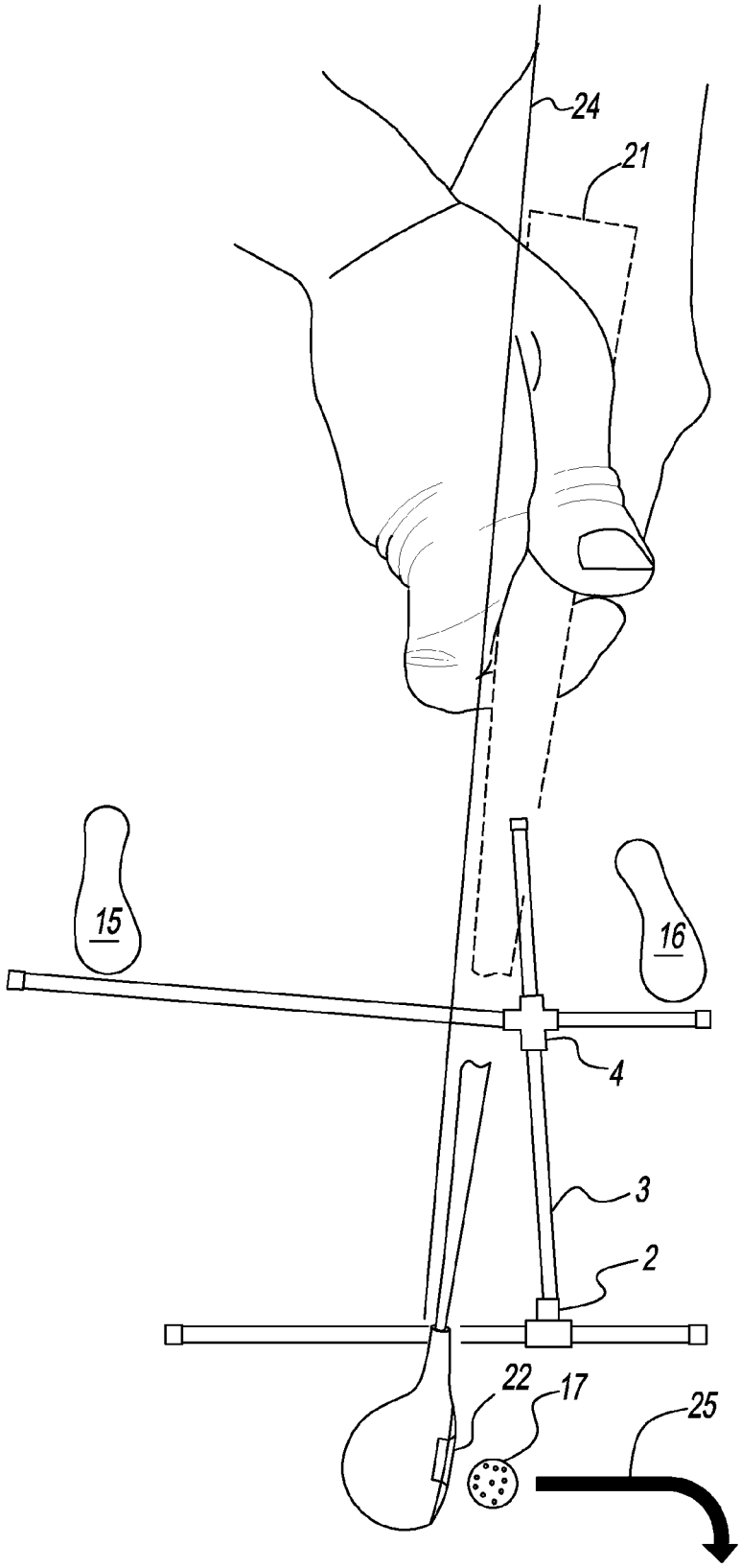
FIG. 24 is a frontal environmental view of the user gripping the club with the shaft angle leaning a bit toward the target, left of the swing axis, the clubface angle open to the target line, and the ball back in the stance, while setting up with the driver to hit a fade.
Figure 25:
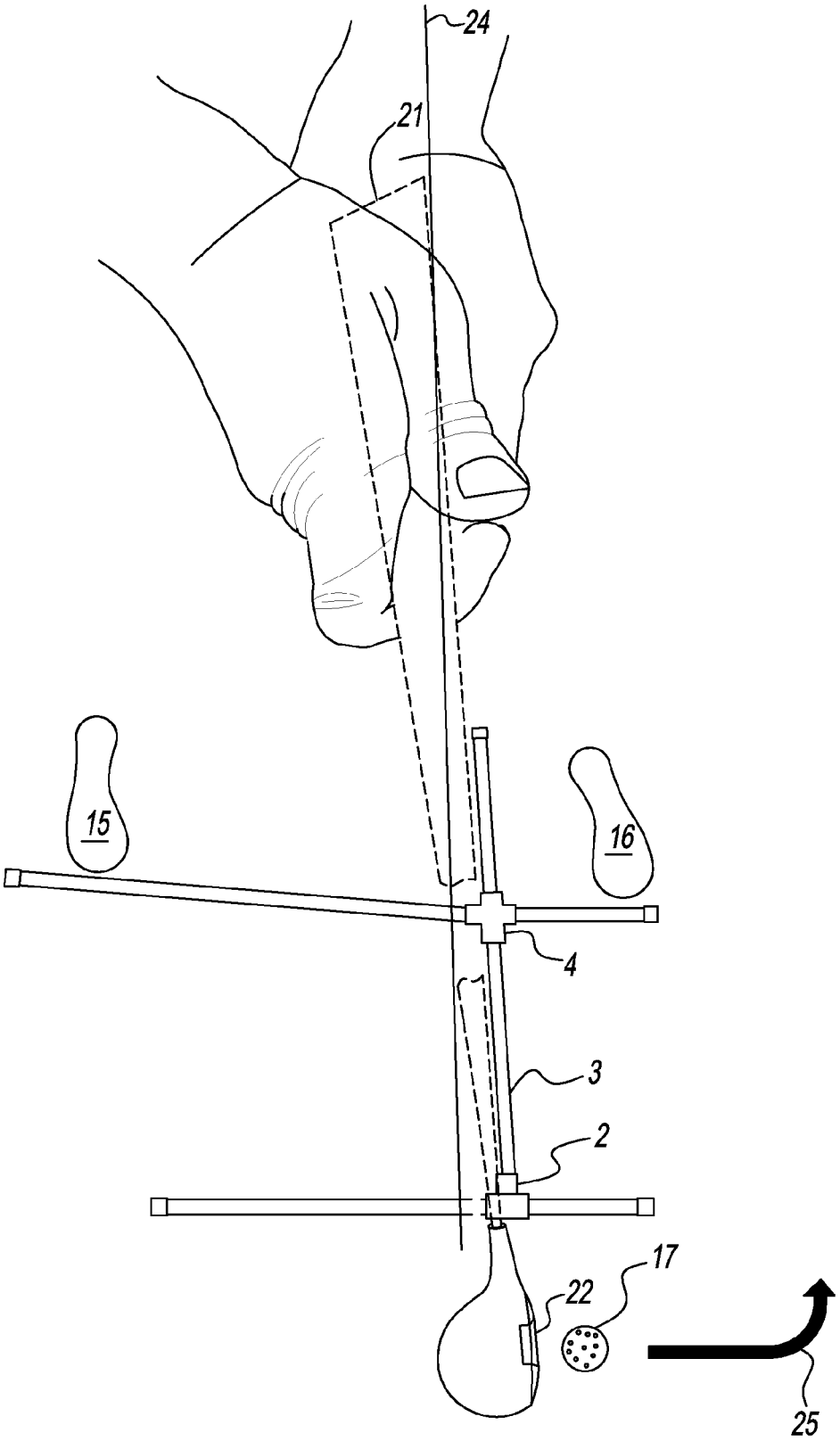
FIG. 25 is a frontal environmental view of the user gripping the club with the shaft angle leaning a bit away from the target, right of the swing axis, the clubface angle closed to the target line, and the ball up in the stance, while setting up with the driver to hit a draw.

The position "A" bar (5) is a guide to set a user's feet, hands and hips having a forward extension (7), a rearward extension (6), and a hands placement guide (4). Both the forward extension (7) and the rearward extension (6) of the position "A" bar (5) have a hinge (8) and a hinge pin (8*a*) enabling the forward extension (7) and the rearward extension (6) of the position "A" bar (5) to rotate toward or away from the takeaway bar (1) as shown by arrows "B" in FIG. 3, making it possible to adjust the swing aid corresponding to the desired stance (open, square, or close) to accommodate the club being played. A coupling (10) connects the forward and rearward extensions (7 and 6 respectively) to the hands placement guide (4). In the exemplary embodiment shown in the figures, the hands placement guide (4) includes a hollow portion forming a placement guide sleeve or bushing (19) as shown in FIG. 2 for the spine angle alignment guide (3) to pass through. The placement guide sleeve (19) and the hands placement guide (4) are slidably movable along the spine angle alignment guide (3). This allows for the apparatus to be further adjustable, and for the playing of all clubs, regardless of length, from the driver to the putter. The placement guide sleeve (19) may fully or partially encircle the spine angle alignment guide (3). In an alternative embodiment, the position "A" bar (5) may be movable along the spine angle alignment guide (3) by an attachment other than the placement guide sleeve (19). For example, the hands placement guide (4) may be removable and placed at a desired position along the spine angle alignment guide (3) using a griping or a clamping feature, corresponding, locating, and/or, engaging features such as a pin or protrusion on the hands placement guide (4), and/or, engaging a hole, recess, catch, or protrusion, or other positioning features along the spine angle alignment guide (3). In an alternative embodiment, in addition to the hands placement guide (4), the apparatus may feature a removable and adjustable putting hands placement guide (4*a*), as shown in FIG. 21, which may be positioned slidably along the spine angle alignment guide (3), so that the swing aid is made more suitable for putting. In yet another embodiment, the position "A" bar (5) may not be attached but positioned by the user relative to the spine angle alignment guide (3) using accompanying graphics or other instructions provided with the swing aid.

Figure 4:
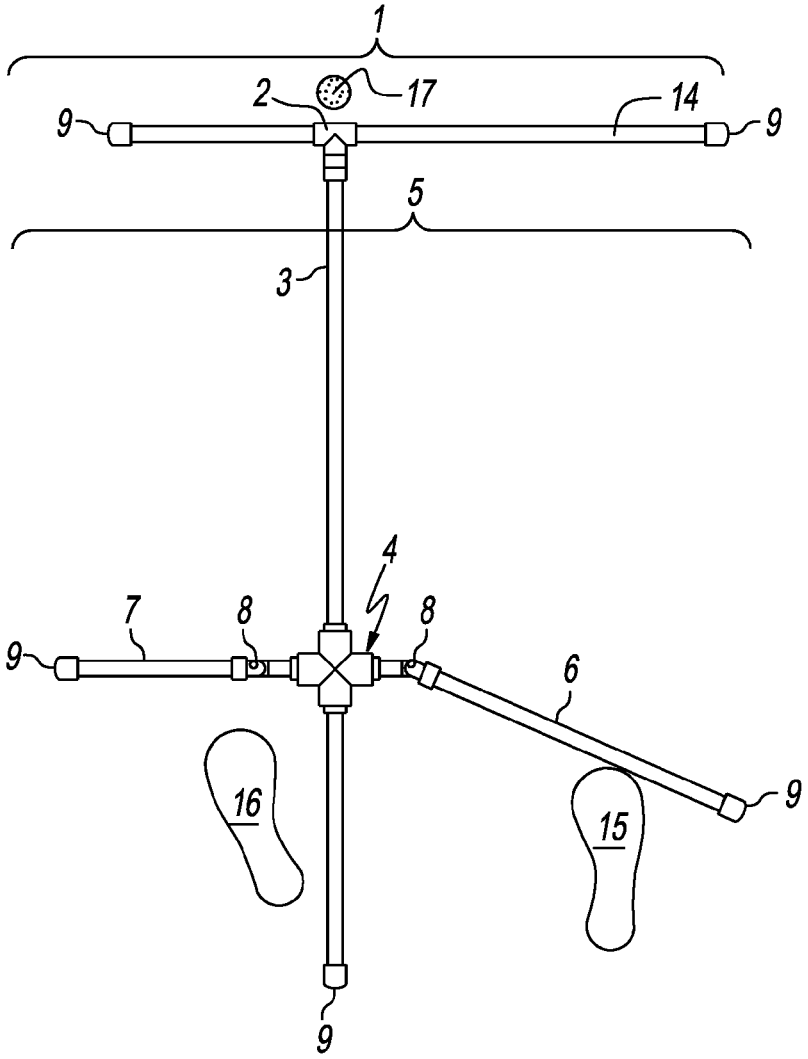
FIG. 4 is a top environmental view showing exemplary positioning of the takeaway bar and the rearward extension of a position "A" bar when hitting a driver.

The takeaway bar (1) includes the ball placement guide (2), shown in FIG. 1 with the ball (17) positioned in front of it, and the elongated bar member (18). Referring to FIG. 2, the end of the spine angle alignment guide (3) includes male threads (11), and the ball placement guide (2) of the embodiment shown in the figures includes an adapter (13) having corresponding female threads (12). In this embodiment, the adapter (13) connects the female threads to the ball placement guide (2). Alternatively, the ball placement guide may include integral female threads without use of an adapter. In the exemplary embodiment shown in the figures, the ball placement guide (2) includes a hollow portion forming a takeaway bar sleeve or bushing (20) as shown in FIG. 2 for the elongated bar member (18) to pass through, making the elongated bar member (18) slidably movable in the takeaway bar sleeve (20) transverse to the spine angle alignment guide (3). The takeaway bar sleeve (20) may fully or partially encircle the elongated bar member (18). In alternative embodiments, the elongated bar member (18) may be movable relative to the ball placement guide (2) by an attachment other than the takeaway bar sleeve (20). For example, the ball placement guide may be removable from the elongated bar member (18) and placed in a desired position along the elongated bar member (18) using a grip or clamping feature, corresponding, locating, and/or, engaging features such as a pin or protrusion on the hands placement guide (4), engaging a hole, recess, catch, or protrusion, or other positioning features on the elongated bar member (18). In yet another embodiment, the ball placement guide (2) may not be attached to the elongated bar member (18) but positioned by the user relative to the elongated bar member (18) using accompanying graphics or other instructions (not shown). As shown in FIGS. 1 and 2, caps (9) are provided at the ends of the takeaway bar (1) and the position "A" bar (5), and at the end of the spine angle alignment bar (3) opposite the takeaway bar (1). FIG. 4 shows exemplary left foot placement (16) and right foot placement (15) of the user when using the present swing aid while swinging a golf club, for example, a driver.

The device may be made from a polymeric material (14) such as polyvinyl chloride (PVC), polyethylene (PE), or other thermoplastic or thermoset material. In a preferred embodiment, the golf swing aid is made from PVC, which is inexpensive, lightweight and durable. Alternatively, the device may be made from other materials such as metal. The construction material may be molded in a desired color or covered with decorative elements of various colors and designs. The golf swing aid may have a brightly colored external surface on one or more than one component. The brightly colored surface may include a vivid color of red, orange, yellow, green, blue, purple, or any other vivid color. Each component may include a different color, or may all be the same color as desired. The ball placement guide (2) and the hands placement guide (4) may be fitted with graphics to indicate the positioning of the hands, ball, and shaft angle so that the user may learn how to "work the ball," or cause the ball to draw or fade as desired for a particular shot. Furthermore, the putting hands placement guide (4*a*), may be fitted with a decal and graphics, conveying information relating to the putting stroke.

Figure 26:
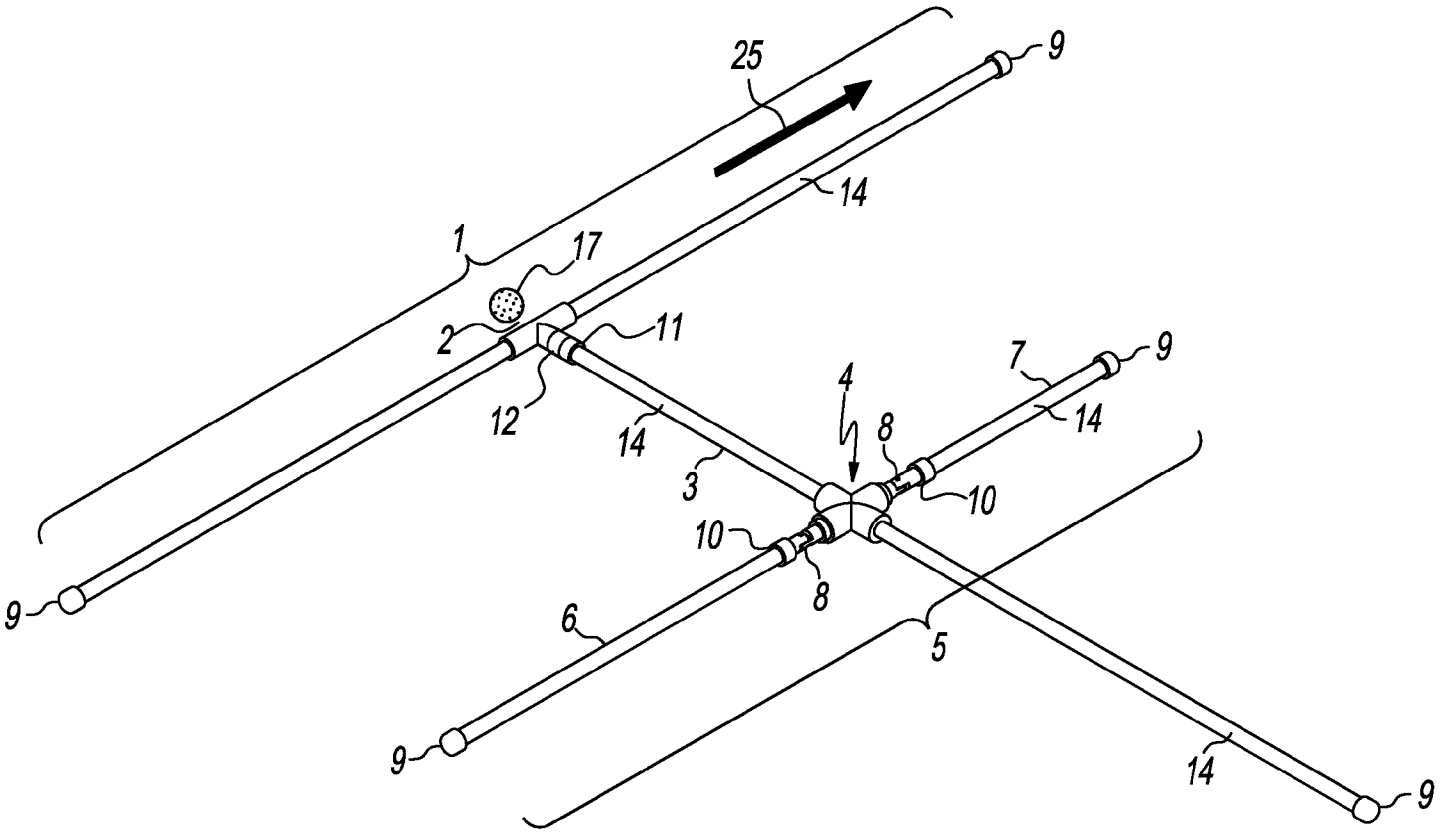
FIG. 26 is a perspective view of the golf swing aid, with the apparatus positioned for use by a left-handed golfer.

As shown in FIG. 26, the apparatus may be made suitable for use by a left-handed golfer by simply rotating the position "A" bar (5) 180 degrees.

Now that we are familiar with the various parts of the device, it may be helpful to consider some of the fundamentals of a golf swing and how the present swing aid may be used to develop a user's swing. These include the grip, alignment, stance, posture, ball position, set up, and the importance of turning around the spine angle (23). Perhaps no swing aid would be complete without a discussion of the grip. Hogan had this to say about the grip:

> When a golfer has completed his left-hand grip, the V formed by the thumb and forefinger should point to his right eye . . . . The grip of the right hand, since it is the hand that does the overlapping, is more complicated. If setting up a strong, correct left hand is one half of the job of establishing a one-unit grip, the other half is getting your right hand in a position to perform its share of the work but no more than its equal share. This means, in effect, subduing the natural tendency of the right forefinger and thumb to take charge. If they do, they'll ruin you. The 'pincher fingers,' the forefinger and thumb, are wonderful for performing countless tasks in daily living such as opening doors and picking up coffee cups, but they are not good at all in helping you to build a good grip and a good swing.

B. Hogan, *Five Lessons The Modern Fundamentals of Golf*, First Fireside Edition, Simon & Schuster, 1957, pgs. 22-24.

Figure 9:
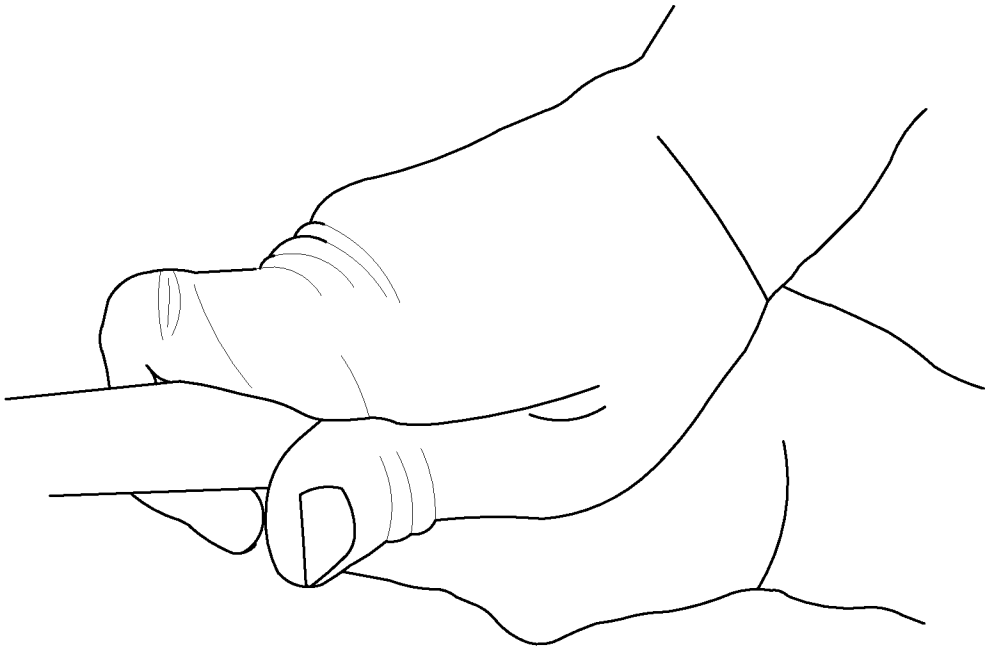
FIG. 9 is a frontal view of a golf grip, showing a strong left hand grip, and the thumb of the right hand grip alongside, not on top of, the shaft, to avoid using the "pincher fingers," and with the base of the thumb and index finger as "inseparable as Siamese twins" to better square the clubface through the impact zone.

Hogan used an overlapping grip, but whether using the overlapping or interlocking grip, the V formed by the left hand thumb and index finger in the grip points to the right eye, with 2-3 knuckles visible from the user's perspective when addressing the ball, to promote a good wrist rotation, and a ball-then-turf contact on the downswing. This grip is described as a "strong grip" because it causes the hands to rotate from an open to close position that with proper technique can help a stronger player hit the ball as hard as possible without hooking. See FIG. 9 for an illustration of an exemplary grip. As shown in FIG. 9, the right hand grip is: (i) in the fingers, (ii) with the thumb alongside (not on top of) the shaft, to help drop the hands "in the slot" during the downswing, and (iii) with the base of the thumb and index finger pressed together.

The following statement gives the user an idea of how important it is to address the ball properly:

> The proper stance and posture enable a golfer to be perfectly balanced and poised throughout the swing Only then will his legs, arms, and body be able to carry out their interrelated assignments correctly.

B. Hogan, *Five Lessons The Modern Fundamentals of Golf*, First Fireside Edition, Simon & Schuster, 1957, pg. 39.

Many great golfers will readily admit that addressing the ball (17), including alignment, stance, posture, and set up, is in fact the major part of the swing. The swing aid addresses all of these concerns.

When using the present apparatus, the takeaway bar (1) is positioned parallel to a target line (25), an imaginary line between the ball and the desired target, with the clubface aligned with the target along the target line (25). The takeaway bar may be extended toward the left for a right-handed golfer as shown in FIG. 1, or may be extended to the right for a left-handed golfer as shown in FIG. 26. For proper alignment with the golf swing aid, the user positions the shoulders (though not necessarily the hips and feet, as this will be depend on club selection), parallel left of the takeaway bar (1) (for a right-handed golfer), and essentially parallel left of the position "A" bar (5). Also, the entire spine angle (23) is aligned in relationship to the target line (25). At address the user's vertebra, and resulting spine angle (23) is positioned transversely to the target line (25). This means that the shoulders are quite level. This positioning of the shoulders aids in rotating the wrists and turning the shoulders on a straight back initial path, as discussed below. Furthermore, this vertical positioning of the spine angle (23) helps to promote good balance. With the spine angle (23) vertically positioned in this manner, and the torso in good equilibrium, the user will find that it is quite easy to hit a 1 or 2 iron.

Figure 10:
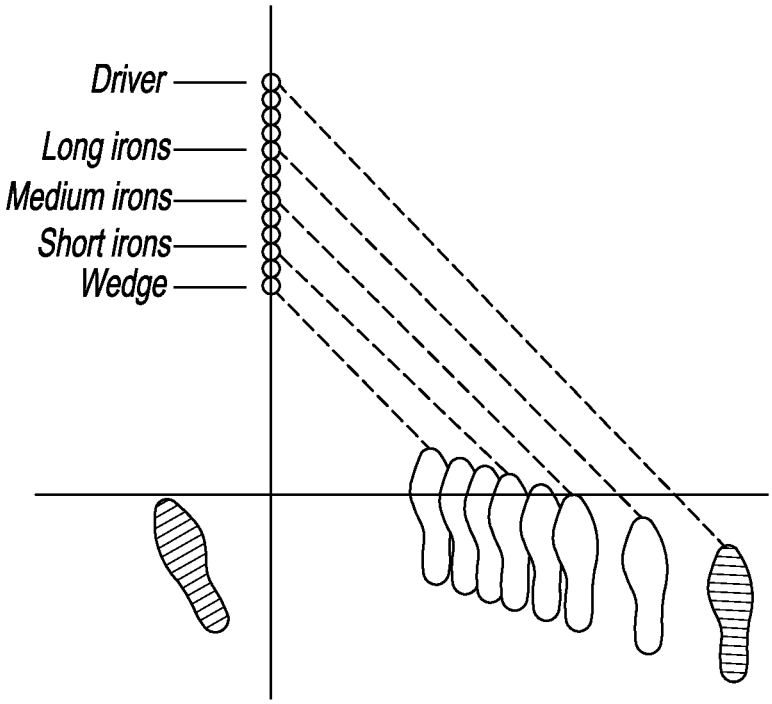
FIG. 10 is a top schematic view of an exemplary stance regiment.

Hogan employed a narrower, open stance when hitting short irons, and a widened and closed stance when hitting longer irons and woods. An open stance is one where the front or left foot placement (16) is further back from the takeaway bar (1) than is the rearward or right foot placement (15). A closed stance is one where the front or left foot placement (16) is closer to the takeaway bar (1) than is the rearward or right foot placement (15). The left foot placement (16) may be opened a quarter turn to help clear the hips and shoulders on the downswing. The right foot placement (15) should point straight ahead to limit and govern the hip pivot, back and through. See, for example, FIG. 10 for a stance regiment for clubs having various shaft lengths. Furthermore, the stance should widen as the length of the shaft increases to provide greater balance. Certain golfers, such as, for example, beginner and amateur golfers, may consider using a squared stance with the feet, hips, and shoulders parallel left of the target line (25) with every club in the bag to better square the torso at address, and to maximize balance. Additionally, hitting long irons and woods may require closing the stance a bit. As used in the present specification and in the appended claims, the term "parallel" is not intended to mean perfectly aligned equidistant apart, but instead means positioned along, or aligned in an approximately parallel position.

In regard to posture, the user should bend slightly from the knees and hips, keep the seat up ("standing tall"), the knees pointing inward, the torso "normally upright," or in an approximately erect posture, and the chin up. Hogan had this to say about the posture:

> When he assumes the 'semi-sitting position,' the upper part of the player's trunk remains relatively erect as he bends at the knees. The knees point in.

B. Hogan, *Five Lessons The Modern Fundamentals of Golf*, First Fireside Edition, Simon & Schuster, 1957, pg. 53.

The swing plane (described below) extends from an imaginary line starting at a point behind the ball (17) and extending upward along the top of the left shoulder. To produce a powerful upright swing plane, the upper torso remains "relatively erect" to establish the upper parameters of the swing plane. When practicing with the swing aid, the user should keep the shoulders from encroaching the position "A" bar (5). If this occurs, the swing plane will be more outside-in (as opposed to inside-out), making it more difficult to hit the ball before hitting the turf, and more difficult to square the clubface to the target at impact.

Regarding ball (17) position, in an exemplary case, the ball (17) is positioned about 2 inches inside the left heel for a straight ball (17) flight. The position of the ball (17) relative to user's stance should be where the clubface squares naturally along the target line (25) through the impact zone. As discussed below, placing the ball (17) 1 inch inside the left heel may produce a draw, where the ball (17) curves from right to left, and placing the ball (17) 3 inches inside the left heel may produce a fade, where the ball (17) curves from left to right. Refer to FIGS. 22B, and 23-25 for an illustration of these principles. For other users, the distance the ball (17) is positioned in the stance for a normal shot may be more or less than 2 inches, based on the height of the golfer, the length of the shafts, and other factors. The ball (17) may be positioned about 8-12 inches in front of the ball placement guide (2) so that the clubhead will not strike the takeaway bar (1).

The set up, including the positioning of the hands, and arms at address, is another fundamental of the swing. This includes everything that occurs involving the arms relative to the torso, including the positioning of the elbows, hands, shaft angle, resulting clubface angle, arms and biceps. The positioning of the elbows is a very important aspect of a good set up. "At address the left elbow should point directly at the left hipbone and the right elbow should point directly at the right hipbone." B. Hogan, *Five Lessons The Modern Fundamentals of Golf*, First Fireside Edition, Simon & Schuster, 1957, pg. 48. Simply stated, at address, the elbow pockets (26) should face more toward each other than toward the sky. This concept for placement of the elbow pockets (26), or "elbow angles," facilitates rotating the forearms and "lifting" the hands and clubshaft to the top of the backswing. The elbows should not point to the sky to enable the user to rotate the arms.

Figure 11:
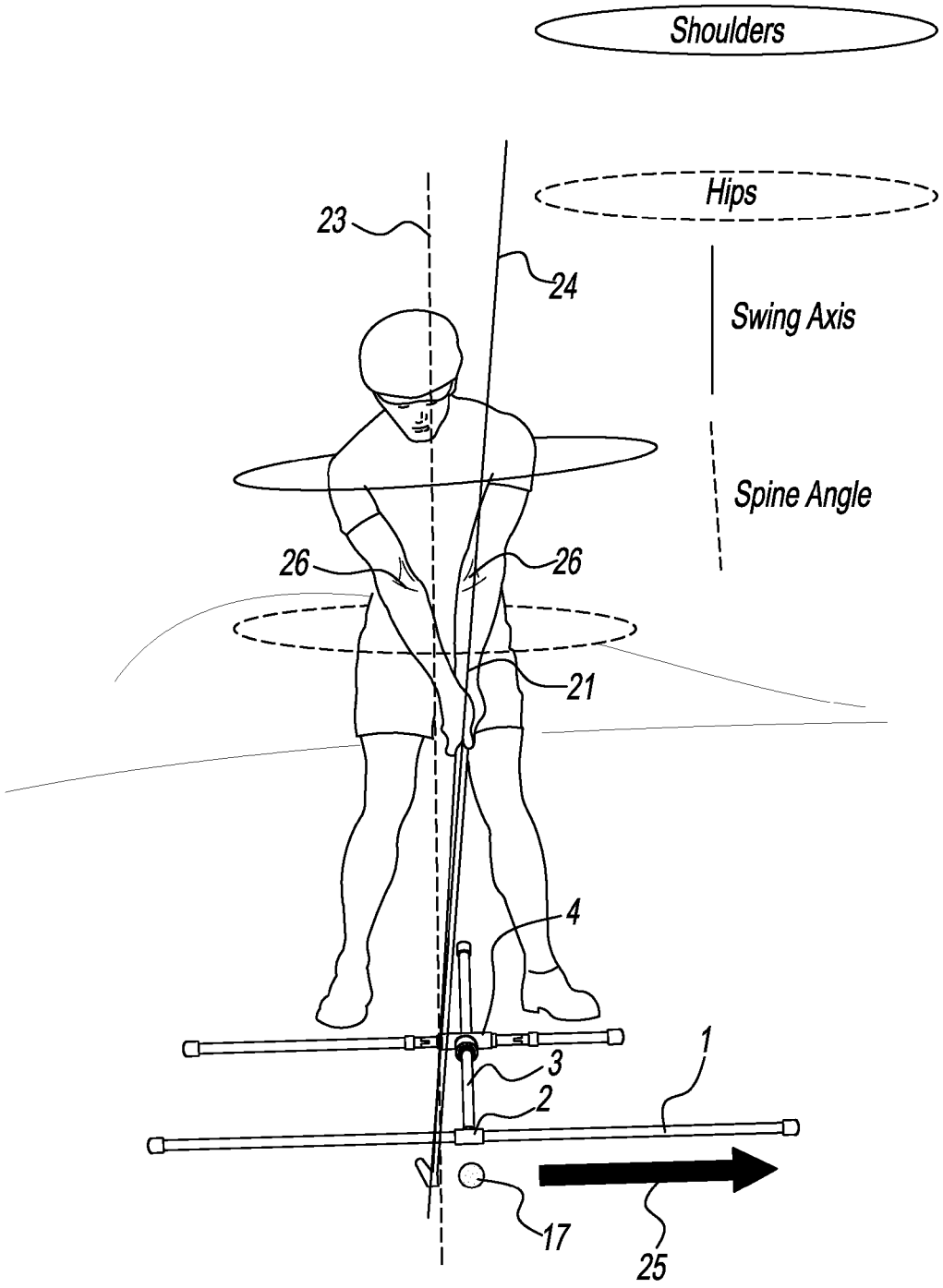
FIG. 11 is a frontal environmental view showing the user exhibiting an exemplary set up at address, with the shoulders parallel left of the target line and level to the ground, the spine angle directly across from the spine angle alignment guide, the ball positioned in the stance and in front of the ball placement guide, the pocket of the elbows somewhat facing each other, the hands over the hands placement guide, the shaft angle generally along the swing axis, the torso normally upright and well-balanced, and the biceps pressed to the sides of the chest.

The hands placement guide (4) provides a visual reference for the user when the user positions his or her hands in the set up. As discussed above, the hands placement guide (4) may include graphics for positioning the hands, ball, and shaft angle, and other information as desired. After the elbows are positioned, the user's hands are positioned vertically over the hands placement guide (4). The premise is that the hands should be positioned where they will square naturally through the impact zone. This position is generally in the center of the torso, opposite the spine angle (23). Thus this is where the hands placement guide (4) is located. The term "spine angle" (23), as used herein, refers to a line, or line segment, starting at the tip of the user's vertebra, extending transversely with the target line (25). Another aspect of a good set up, and one that is closely related to the placement of the hands, is the shaft angle (21). In general, the shaft angle (21) should be in line with the swing axis (24) at address. Referring to FIGS. 11, 22A, and 23-25, as used herein, the "swing axis" is a line that extends from a position behind the ball (17), and extends upward through the left shoulder. The "swing axis" (24) lies along a vertical line on the swing plane that is discussed below. Also referring to these figures, the "shaft angle" (21) is positioned in the grip shown in FIG. 9, in relationship to the swing axis (24). The alignment of the shaft angle (21) along the swing axis (24) causes the shaft and clubhead to move along the swing plane, as described below. A neutral shaft angle (21), where the shaft angle (21) is aligned along the swing axis (24), results in the clubface angle (22) being squared along the target line (25). This shaft angle (21) and corresponding clubface angle (22) produce an end-over-end revolution of the ball (17), which causes the ball (17) to travel in a straight path. Working the ball, therefore, as discussed below, may be accomplished by changing the shaft angle (21) alone. These ideas are discussed below. Another aspect of the set up is the need to keep the arms (especially the left arm) extended or straight. When the left arm is bent at impact, the clubface tends to look left, resulting in a hooked or pulled shot. At address, the user's biceps are pressed to the sides of the chest and should remain so through the impact zone. This is the case because in the golf swing, there should only be two points of rotation: the point where the clubhead, hands and forearms rotate; and where the torso turns around a fixed spine angle. If the biceps are not pressed to the sides of the chest, there will be a third point of rotation between the biceps and the torso. This makes it very difficult to properly execute the backswing, and to drop the hands "in the slot" (described below) on the downswing. The result may be topping and pulling. After setting up correctly, with the biceps pressed to the sides of the chest, the user should sense that the hands, arms, and shoulders form a "triangle." This "triangle" is maintained throughout the swing, except at the top of the backswing where the right arm bends and the right elbow folds close to the chest, and well after impact, as the left arm bends at the elbow. Furthermore, maintaining the "triangle" makes it much easier to build a dependable swing because the user now has to simply focus on maintaining the "triangle," not on maintaining the various aspects of a good set up. An exemplary set up is shown in FIG. 11.

An additional concept fundamental to a good golf swing is turning the torso (i.e., the hips and shoulders) around the spine angle (23) moving the club along the swing plane. As used herein, the term "swing plane" refers to an imaginary plane, beginning from a point behind the ball, extending through the swing axis (24) and through the target line (25). The hitting area or "impact zone," where the ball (17) is struck, is at or along the swing axis (24). A primary purpose of the swing aid is to teach the user how to swing the clubhead along the swing plane. Dipping, swaying, or picking up during the swing are not elements of a Hogan golf swing. An important factor in the golf swing in this regard is the hip pivot. During the pivot, as the shoulders and hands are being carried upward, there is a tendency to pick up the torso. The same tendency is present during the reverse pivot. The spine angle alignment guide (3) provides a visual reference for the user when the user positions his or her torso in the set up. By setting up with the spine angle (23) in line with the spine angle alignment guide (3), which may be brightly colored for easy reference, the user will quickly learn to turn the torso, back and through, without picking up nor swaying.

Combining the golf swing aid and the concepts of a golf swing, one can see how the user may interact with the apparatus. In regard to alignment, the apparatus should be positioned on the ground or a mat at a driving range, for example, so that the takeaway bar (1) is aligned parallel left of the target line (25) as shown in FIG. 11. At address, the user's shoulders are parallel with the takeaway bar (1). The ball (17) may be positioned about 2 inches inside the left heel of the left foot placement (16), and about 8-12 inches in front of the ball placement guide (2). The user's spine angle (23) should be directly across from the spine angle alignment guide (3), and the shoulders are level. Addressing the ball in this manner helps to align the torso in a squared and parallel manner in relationship to the target line (25), and makes it much easily to deliver the clubhead squarely into the back of the ball.

Figure 3:
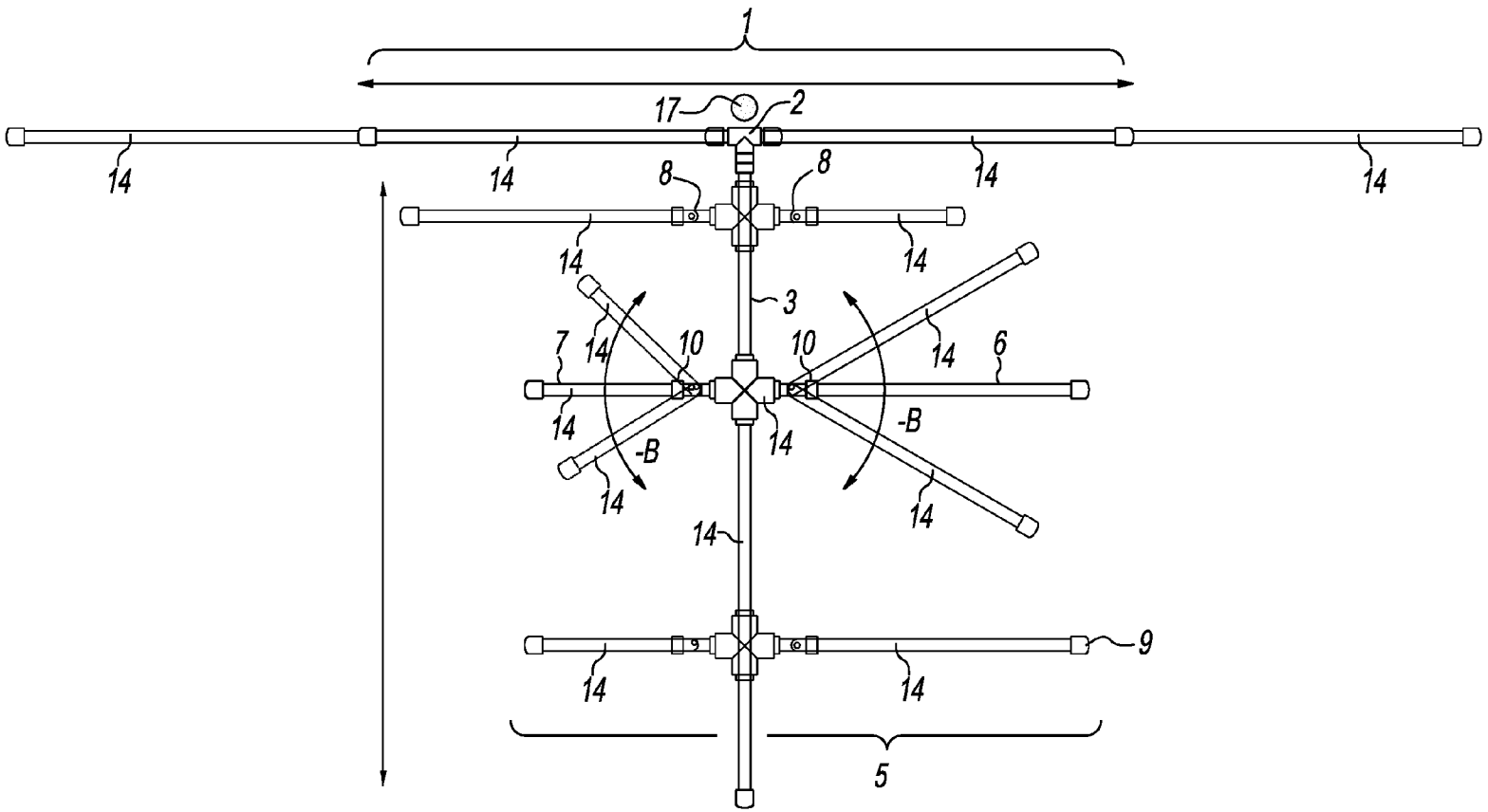
FIG. 3 is a top environmental view showing range of motion of the present swing aid.

As shown in FIG. 3, the device has an adjustable position "A" bar (5) that helps the golfer to take a proper stance. The device may be adjusted by movement of either the forward extension (7) or the rearward extension (6) of the position "A" bar (5), or both. As both the forward extension (7) and the rearward extension (6) have hinges (8), and hinge pins (8*a*), both extensions are able to rotate toward or away from the takeaway bar (1) as shown by arrows "B" in FIG. 3. This adjustment allows the swing aid to be adjusted corresponding to the desired stance (open, square, or close) to accommodate the club being played. For example, the golfer is able to adjust the position "A" bar (5) bar to produce an open stance that may be useful when hitting a short iron shot such as a 9 iron. Further, the swing aid allows for the stance to instead be widened and closed, which may be useful when hitting the driver. Adjusting the stance (open to close and narrow to wide), depending on club selection, may affect the path, rotation, and squaring of the hands, and calibrates the squaring of the clubface though the impact zone. For example, "opening up" on the short irons may help to hit these clubs more accurately, while using a wide, closed stance when hitting long irons and woods, may help to square the clubface more easily, even with relatively stiff shafts. Furthermore, during the downswing, the spine angle alignment guide (3), acts as a boundary line over which the head and the spine angle (23) generally should not cross before impact with the ball (17) is made. See, FIG. 16. With the help of the golf swing aid, the user will learn to "stay behind the ball," and, as a result, will reduce topping and hooking, leading to better hits and lower golf scores.

Figure 12:
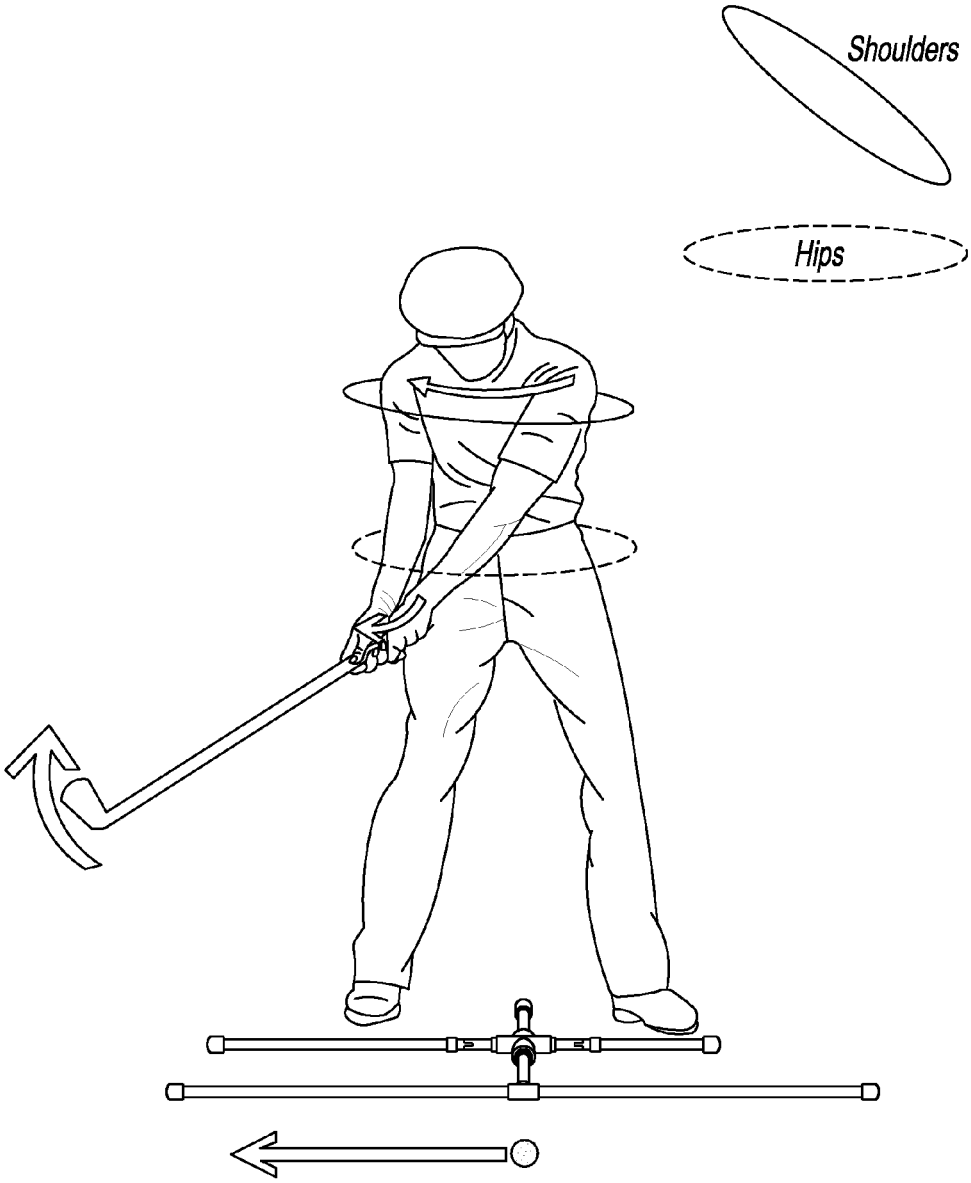
FIG. 12 is a frontal environmental view showing the rotation of the wrists and clubhead, the initial movement of the clubhead approximately parallel to the takeaway bar, and the turning of the shoulders during the takeaway.

Ben Hogan's swing consists of two distinct planes. Referring to FIGS. 12-18, during the backswing, the clubhead initially travels on an outside plane along, and parallel to the takeaway bar (1). As the hips pivot, the clubhead moves to an inside plane as it travels over the rearward extension of the position "A" bar (6). At the top of the swing, the shaft is aligned parallel to the takeaway bar (1), and the shaft and the hands mark the top of the swing plane. During the downswing, the hands drop nearly vertically "in the slot," starting the clubhead on a path that is inside the initial backswing plane. As the clubhead continues on the downswing plane, the reverse pivot, shoulder turn, and wrist rotation cause, the left wrist to "supinate" or to become a bit convex, the clubhead to rotate and square at impact, and to finish just outside the initial backswing plane. The apparatus aims to capture, and to shed some light on, this two-plane swing concept. The apparatus's design helps the user to better understand the swing plane, and, therefore, become a better, more consistent ball striker. "On the backswing, the correct order of movement is hands, arms, shoulders, hips," B. Hogan, *Five Lessons The Modern Fundamentals of Golf*, First Fireside Edition, Simon & Schuster, 1957, pg. 72. The apparatus is able to teach the order of these movements. As stated above, the user sets up with spine angle (23) opposite the spine angle alignment guide (3), the shoulders level and parallel left of the target line (25), and the torso in equilibrium. During the takeaway (i.e., the start of the backswing), the wrists or hands start back first, rotating the clubhead 45 degrees on a straight back initial path parallel to the takeaway bar (1), and thus to the target line. As the hands turn, the forearms also turn; then, nearly simultaneously, the shoulders turn 45 degrees, and the clubhead moves slightly inside, a bit closer to the takeaway bar (1). As shown in FIG. 12, this movement signals the end of the takeaway.

Figure 5:
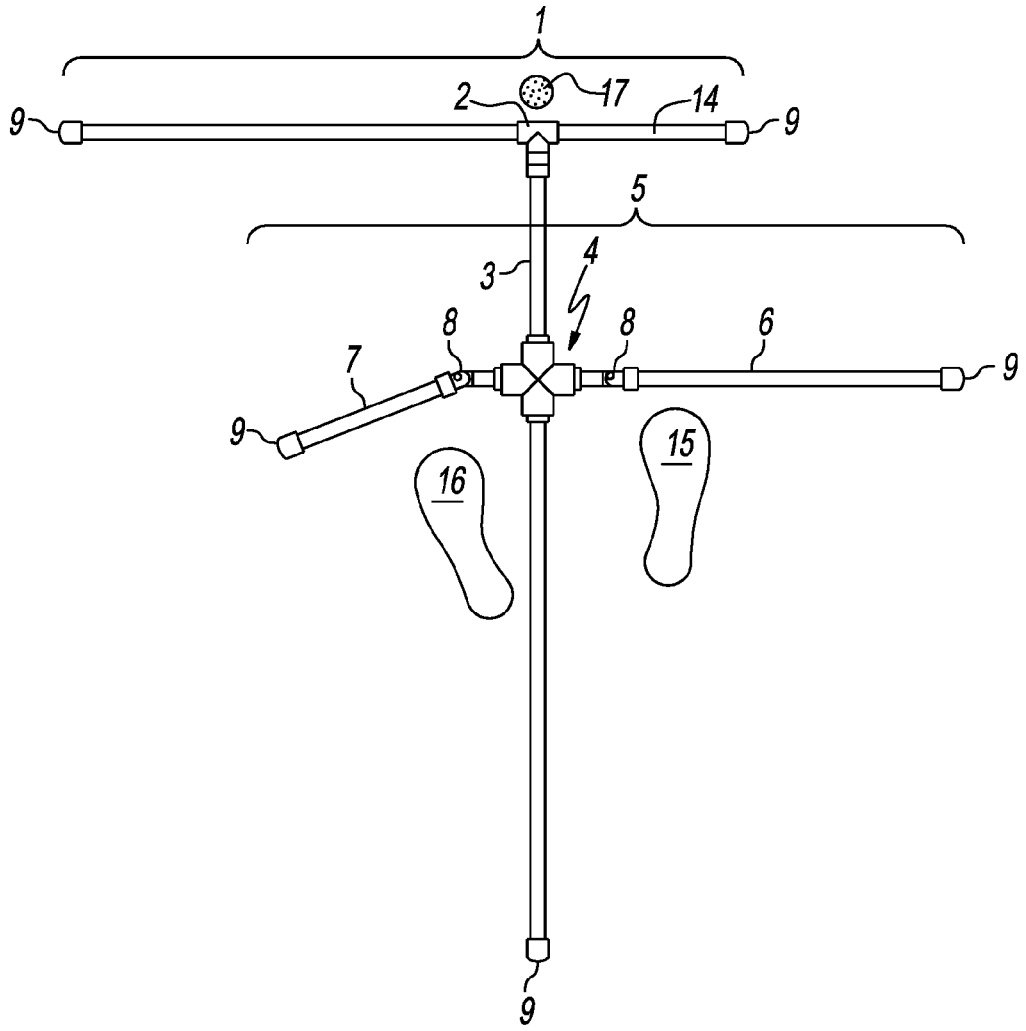
FIG. 5 is a top environmental view showing exemplary positioning of the takeaway bar and forward extension of the position "A" bar when hitting a short iron.
Figure 6:
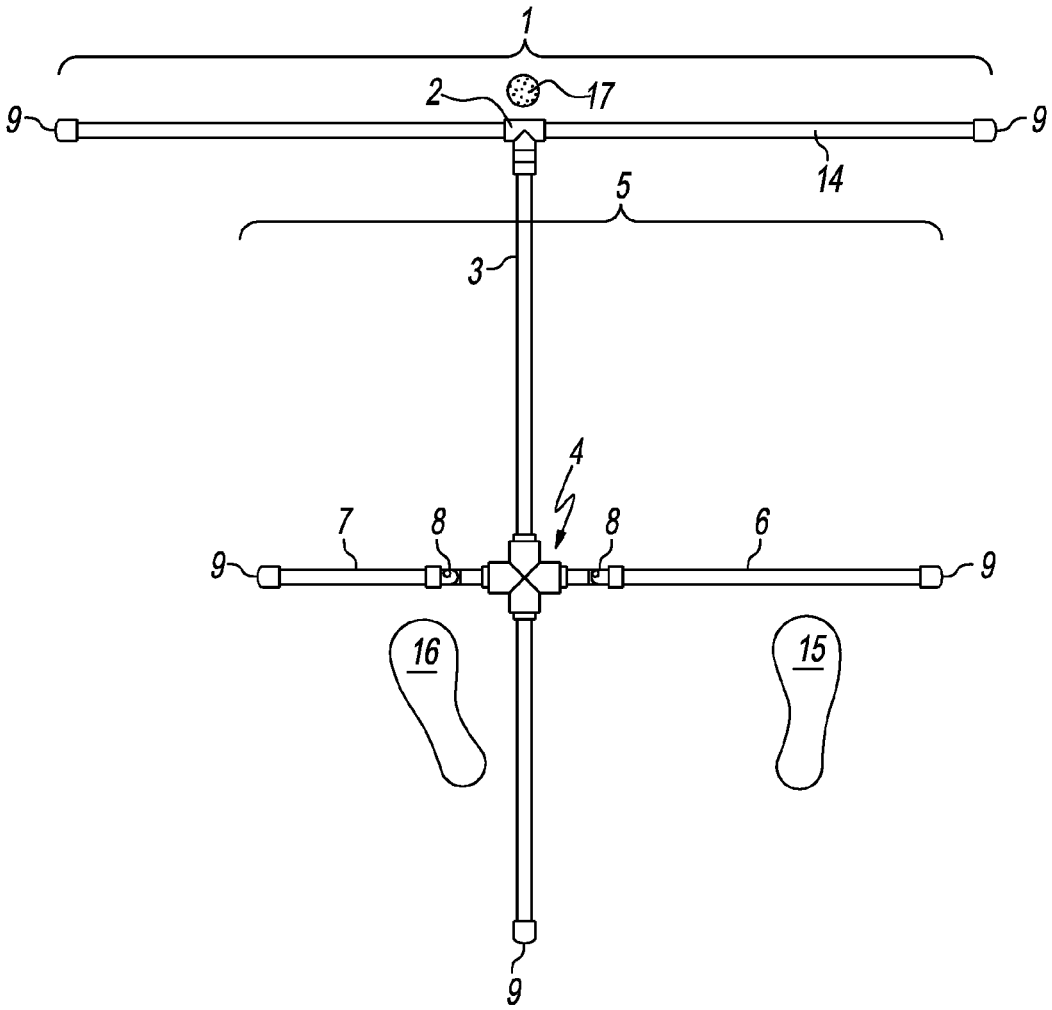
FIG. 6 is a top environmental view showing exemplary positioning of the takeaway bar and the position "A" bar when hitting a middle iron, for example a six iron.
Figure 7:
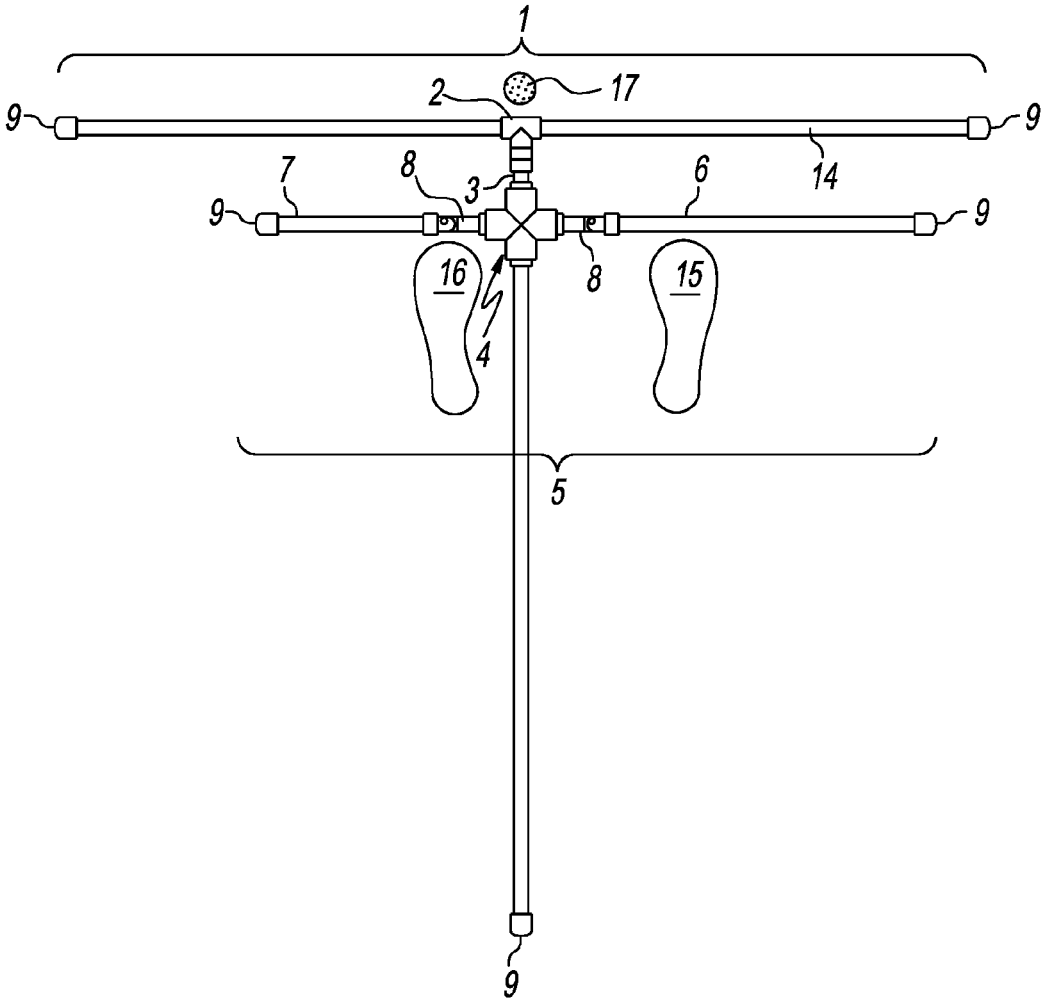
FIG. 7 is a top environmental view showing exemplary positioning of the takeaway bar and of the position "A" bar when putting.

As stated above, the takeaway bar (1) is adjustable along the target line. As shown in FIGS. 4-6, when hitting a shorter club, less extension is required, and the takeaway bar (1) may be pushed closer to the target. The opposite is true when hitting the driver, i.e. the takeaway bar (1) may be pulled away from the target, allowing the golfer to have more extension in his or her swing during the takeaway. If the user fails to rotate the wrists, but executes a shoulder turn (and hip pivot), the result may be leaving the clubface open at the top and pushing. On the other hand, if the user rotates the wrists, but fails to turn the shoulders (while executing a proper hip pivot), the result may be a closed clubface at the top and pulling. So, the user will learn the importance of rotating the hands straight back from the target to set the wrists at the top, and turning the shoulders to create the necessary extension in the swing. See, FIG. 12. During the downswing, the reverse pivot will cause the shoulders, arms, and wrists to reverse their rotation, and square the clubface along the target line (25). Thus the rotation of the wrists and turning of the shoulders during the backswing are condition precedents to squaring the clubface during the downswing.

Figure 12A:
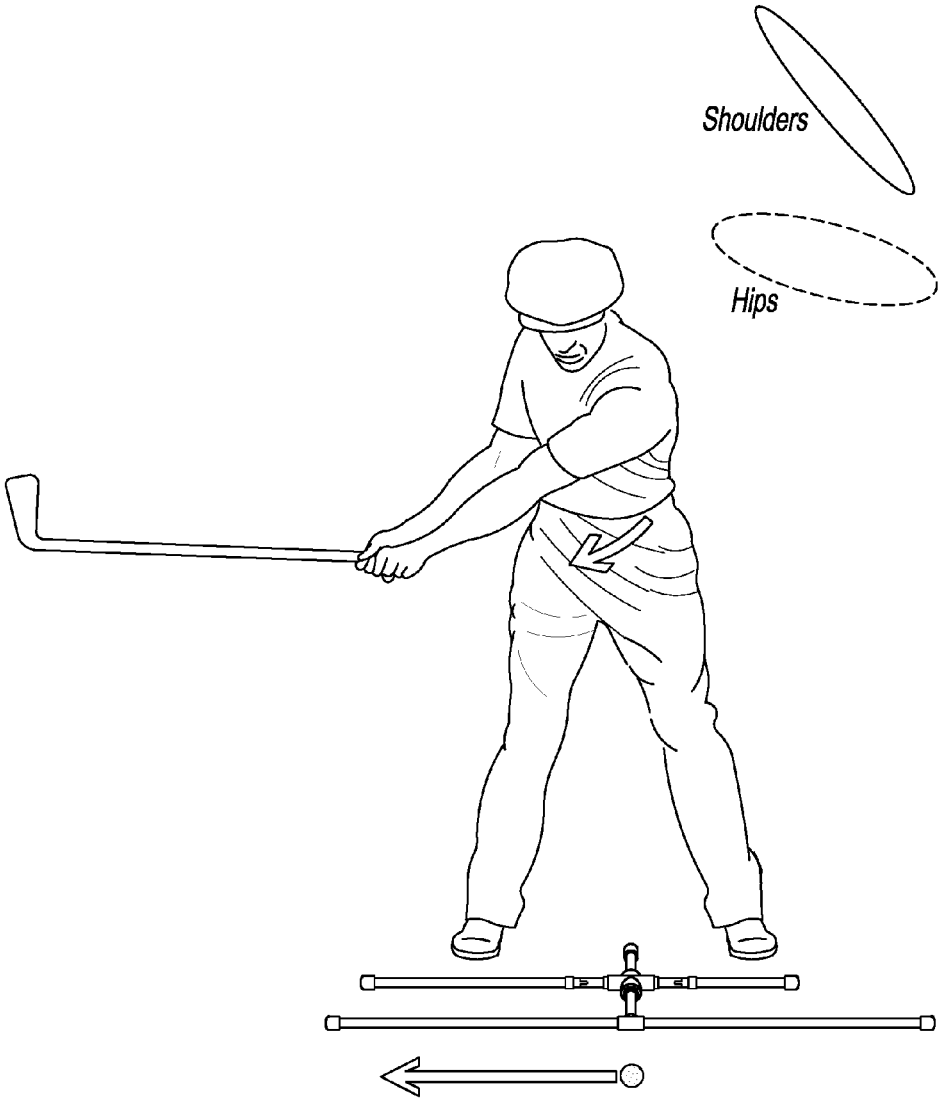
FIG. 12A is a frontal environmental view showing the initial stages of the hip pivot, with the clubshaft extended away from the target and over the position "A" bar during the backswing.
Figure 13:
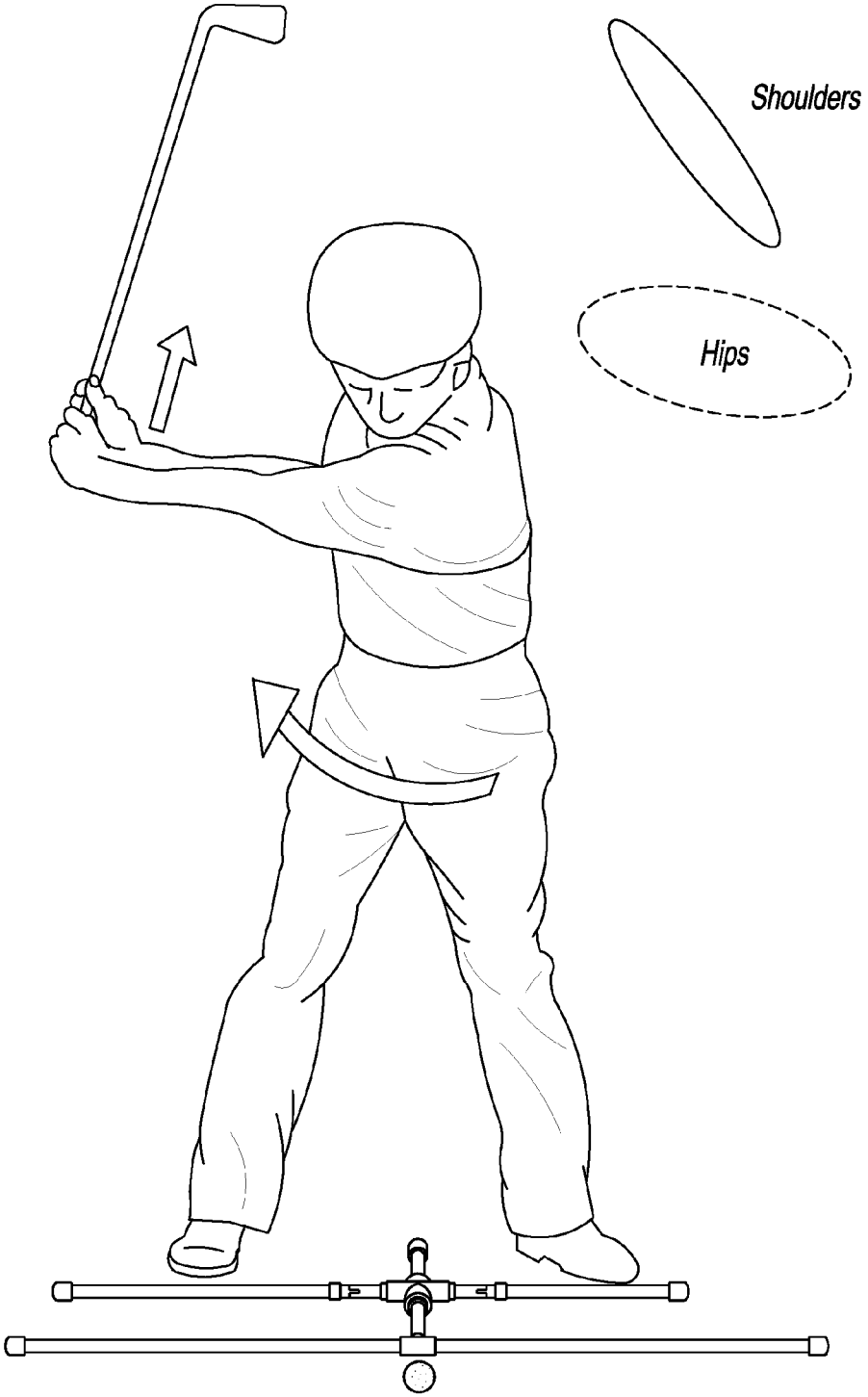
FIG. 13 is a frontal environmental view showing the left arm over the position "A" bar, with the clubshaft pointing skyward nearing the end of the backswing.
Figure 14:
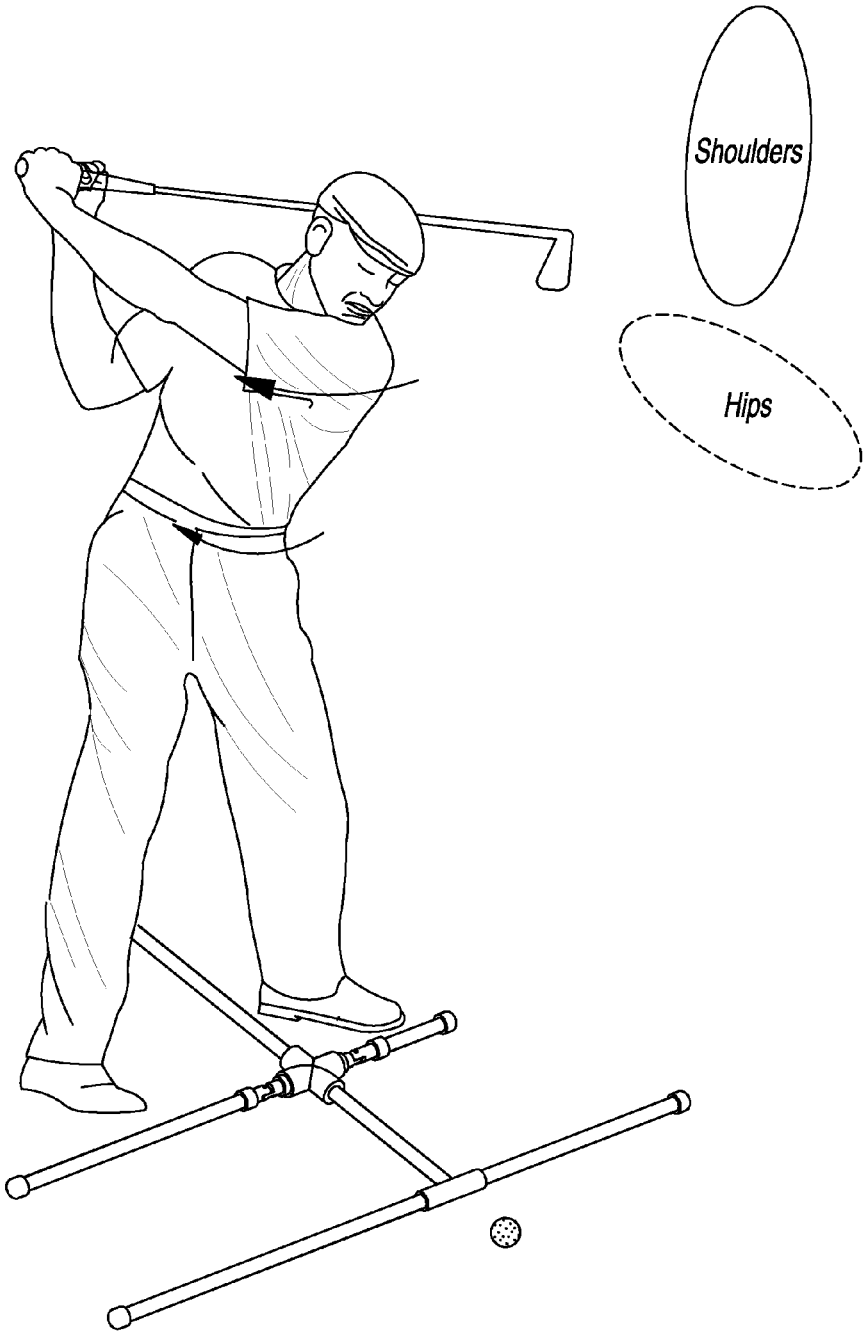
FIG. 14 is a perspective view showing positioning of the hips, shoulders, arms, and wrists, with the shaft parallel to the takeaway bar at the top of the swing.

Referring now to FIGS. 12A, 13 and 14, after the takeaway, the hips should begin to pivot 45 degrees. The hip pivot is important to the overall success of the swing. The 45 degree turning of the hips should cause the shoulders to turn (or to be "carried") an additional 45 degrees, and the clubface to also rotate an additional 45 degrees. As the hips start to pivot, the left arm moves to a position over the rearward extension of the position "A" bar (6), the shaft angle (21) points parallel along the target line (25), the clubshaft becomes horizontally parallel over the position "A" bar (5), and weight shifts to the right side. See, FIG. 12A. As the hips continue to pivot, the forearms continue to rotate and to lift the shaft to the top of the swing, and the club shaft points upward. The user now uses the inertia created by the hip pivot and the shoulder turn, and the powerful forearm muscles to lift the hands an additional 90 degrees all the way to the top of the swing. This part of the swing is misunderstood by most golfers, and the common mistake is to over-rotate the shoulders and hips to get the hands to the top, which generally leads to hitting the ball right of the target line (25). The task of lifting the hands the remaining 90 degrees to the top, is made much easier if: i) the elbow pockets (26) are facing each other, ii) the arms are extended, and iii) the biceps are pressed to the sides of the chest, forming a "triangle" as stated above. At the top, the wrists will have rotated 90 degrees, the shoulders will have turned 90 degrees, the hips will have pivoted 45 degrees, the hands will have traveled 180 degrees, and the clubshaft and clubhead will have rotated nearly 270 degrees. This differential between the 90 degree shoulder turn (and wrist rotation), 45 degree hip pivot, 180 degree movement of the hands, and 270 degree rotation of the shaft and clubhead, creates resistance between the upper and lower body, produces coil, lag, and massive clubhead speed. At the top of the swing, the shaft should be parallel to the takeaway bar (1), and the target line (25). Only now is it possible to start the downswing correctly. If the hips do not pivot 45 degrees, the hands may not be positioned over the position "A" bar (5) at the top of the swing, which is where they should be at this stage of the swing, and the clubface may be opened at the top. During the downswing, the hands would fail to drop "in the slot," the wrists would not "supinate," and the likely result may be a pushed shot. A "push" or a "slice" is where the ball (17) travels to the right of the target line (25) for a right handed player. A "hook" or a "pull" is where the ball (17) travels to the left of the target line (25) for a right handed player.

Figure 19:
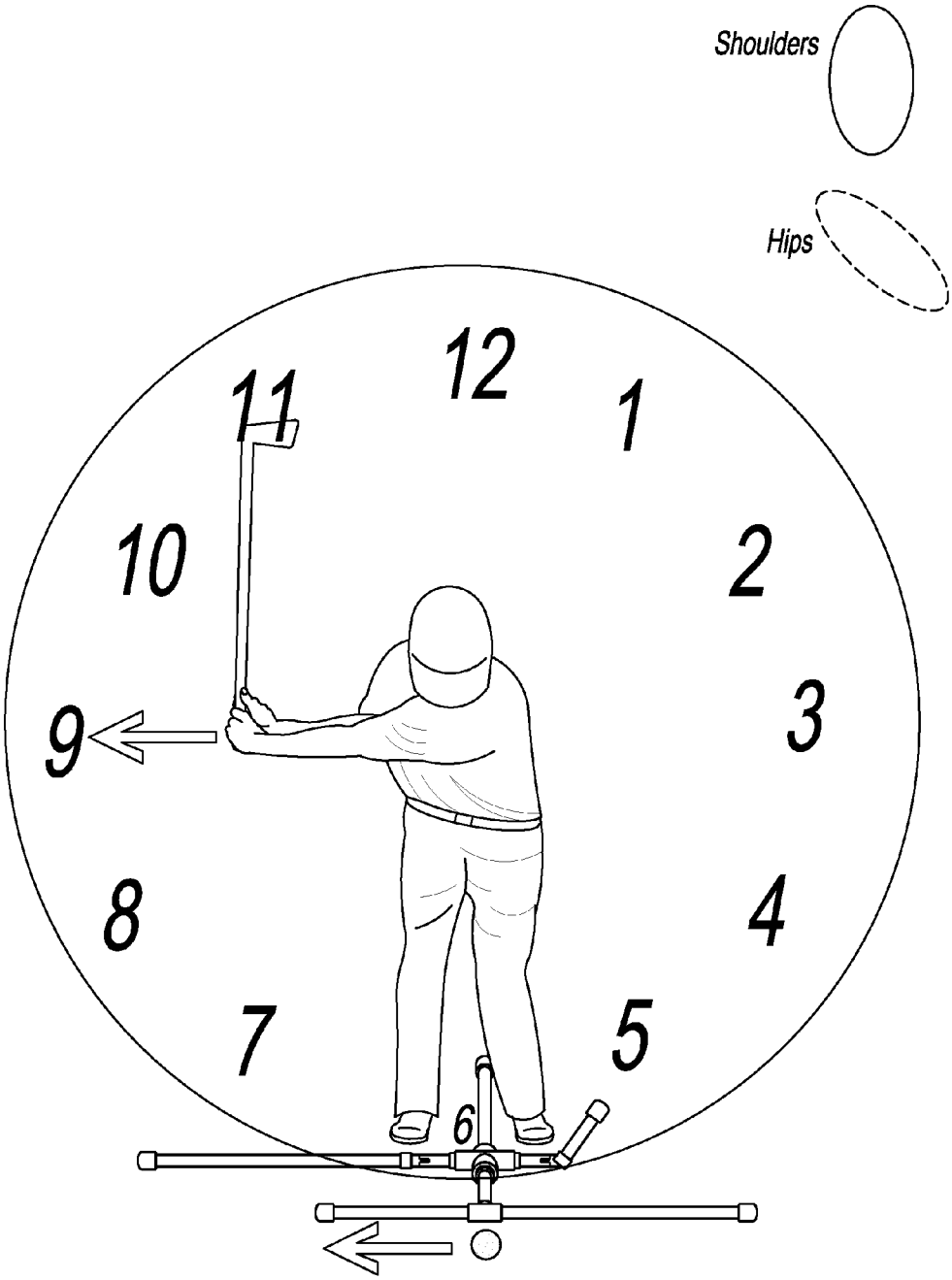
FIG. 19 is a frontal environmental view showing the execution of a finesse swing, with the hands at the 9 o'clock position, a near 45 degree hip pivot, and a near 90 degree shoulder turn, and with the left arm over the position "A" bar.
Figure 20:
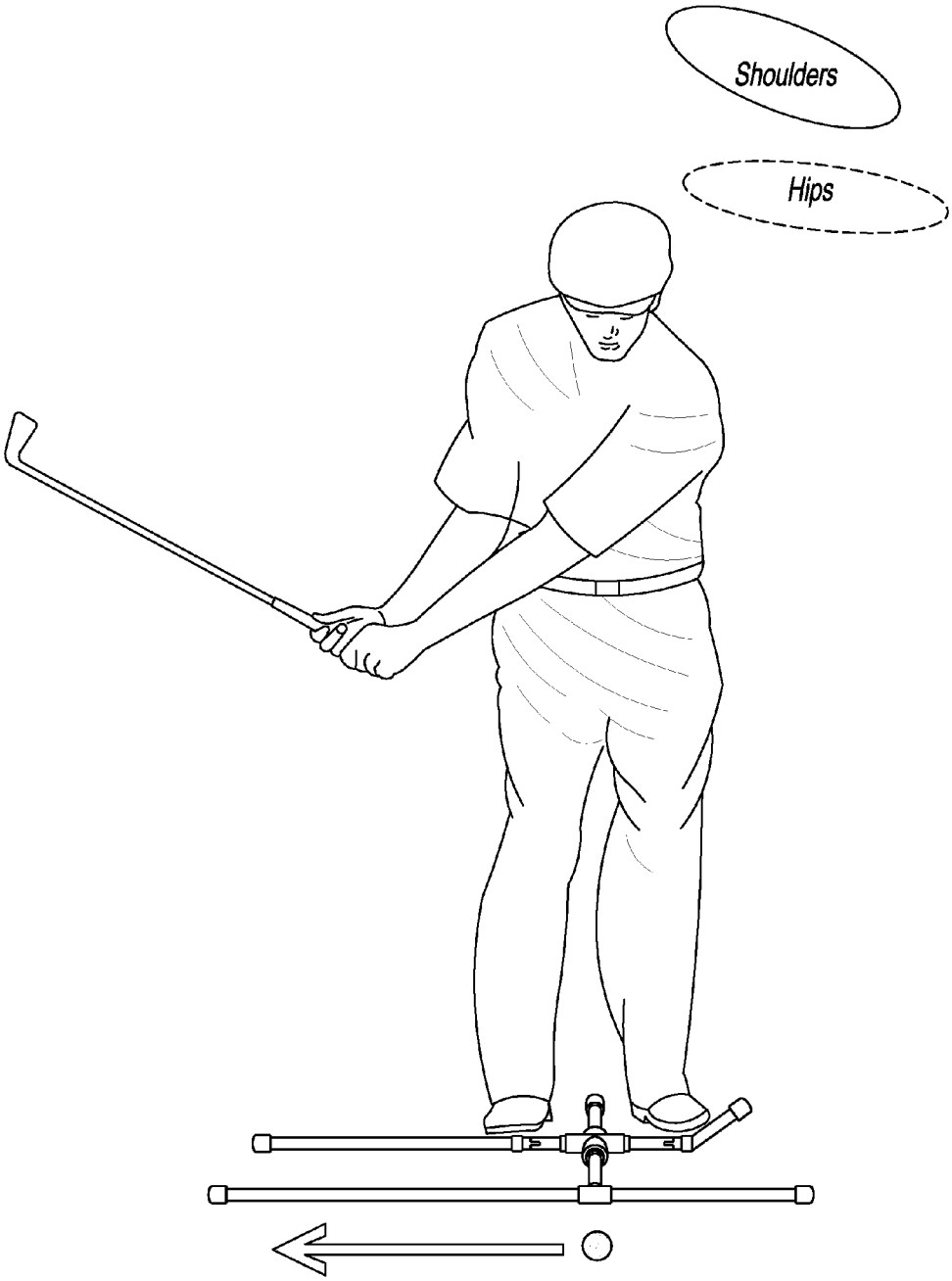
FIG. 20 is a frontal environmental view showing the execution of a pitch or long chip shot, a near 45 degree shoulder turn and 22½ degree hip pivot, resulting in the left arm being positioned about halfway between the takeaway bar and the position "A" bar.

As shown in FIGS. 12, 12A, 13 and 14, during the backswing, the takeaway bar (1) is to the rotation of the hands and the turning of the shoulders, as the position "A" bar (5) is to the hip pivot and the position of the left arm, hands, and shaft at the top of the swing. When the hips have pivoted properly (45 degrees for the full swing and the finesse shot), the left arm, hands, and shaft will assume their correct position over the position "A" bar (5). A good knowledge of swing theory is important to understanding the mechanics of the golf swing. In regard to the full swing, the user should turn the shoulders and rotate the wrists 90 degrees, while pivoting the hips only 45 degrees, as shown in FIG. 14. As Hogan may have recognized, there is generally a 2:1 ratio between the shoulder turn and hand rotation, and the hip pivot. Looking at FIG. 19, this swing concept is also true for the finesse swing where the shoulders turned nearly 90 degrees, and the hips pivot nearly 45 degrees, moving the left arm and shaft over the position "A" bar (5); but note that the user's hands are at the 9:00, not the 12:00 o'clock position. Referring to FIG. 20, to the apparatus can teach the execution of a pitch or long chip shot wherein the shoulders should turn and the hands should rotate nearly 45 degrees, while the hips should pivot only about 22½ degrees. The apparatus enables the user to get a better understanding of this 2:1 ratio concept, which is not only helpful for mastering the full swing, but is also helpful for improving the short game.

Hogan advocated starting the downswing with the hips. He had this to say about the downswing:

> THE HIPS INITIATE THE DOWNSWING. They are the pivotal element in the chain action. Starting them first and moving them correctly—this one action practically makes the downswing. It creates early speed. It transfers the weight from the right foot to the left foot. It takes the hips out of the way and gives your arms plenty of room to pass . . . .

B. Hogan, *Five Lessons The Modern Fundamentals of Golf*, First Fireside Edition, Simon & Schuster, 1957, pg. 90.

As shown in FIGS. 15-18, the execution of the downswing includes keeping the biceps pressed to the sides of the chest, maintaining the tilt angle (no picking up of the torso), initiating the downswing by reversing the hip pivot while moving the hands over the position "A" bar (5), turning the torso in line with the spine angle alignment guide (3), and finishing with the belt buckle left of the target line (25) and the hands high. The position "A" bar (5) may be brightly colored to better teach the user how to use the hips to move the hands during the downswing. The term "in the slot" is used herein to describe the movement of the hands from the top of the swing vertically downward over the takeaway bar, as a result of the reversing the hip pivot and shifting weight back to the left side, and while keeping the biceps pressed to the sides of the chest. See, FIG. 15 for an illustration of the user using the hips to drop the hands "in the slot" at the beginning of the downswing.

Figure 15:
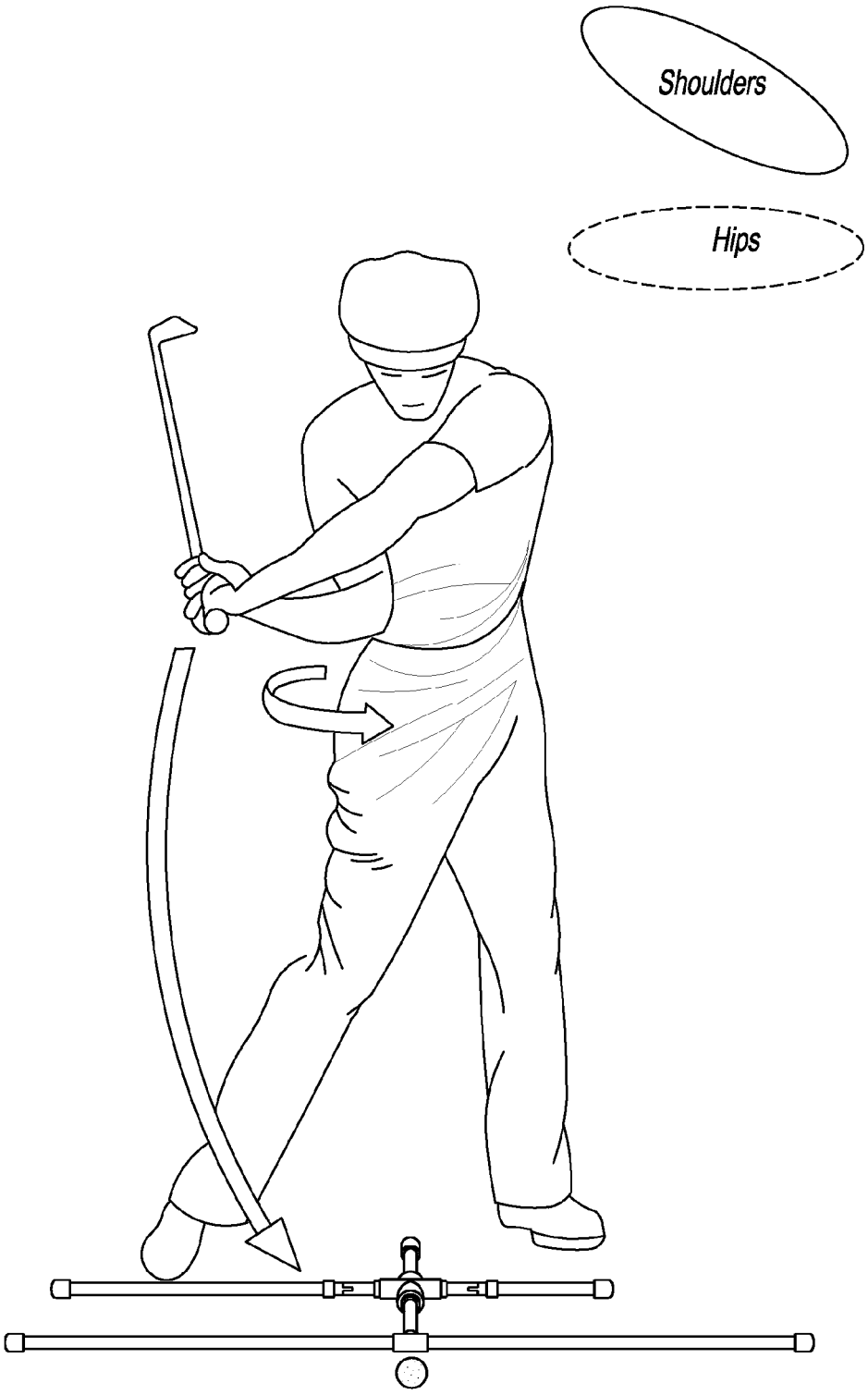
FIG. 15 is a frontal environmental view showing the reverse pivot, and the movement of the hands over the position "A" bar at the start of the downswing.
Figure 16:
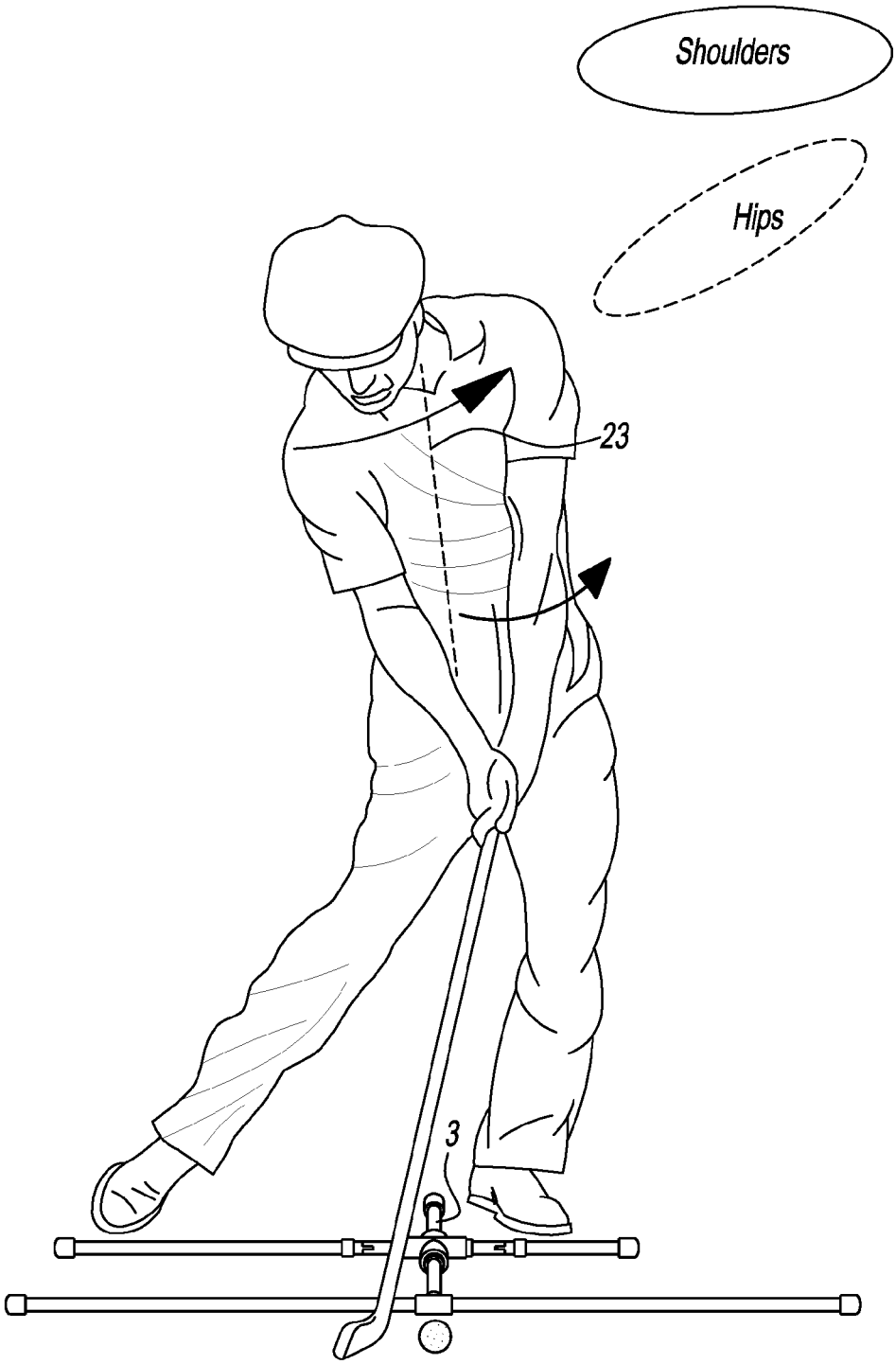
FIG. 16 is a frontal environmental view showing the impact position, with the hands back to their original position over the position "A" bar and the hands placement guide, and with the head and spine angle remaining behind the spine angle alignment guide.
Figure 17:
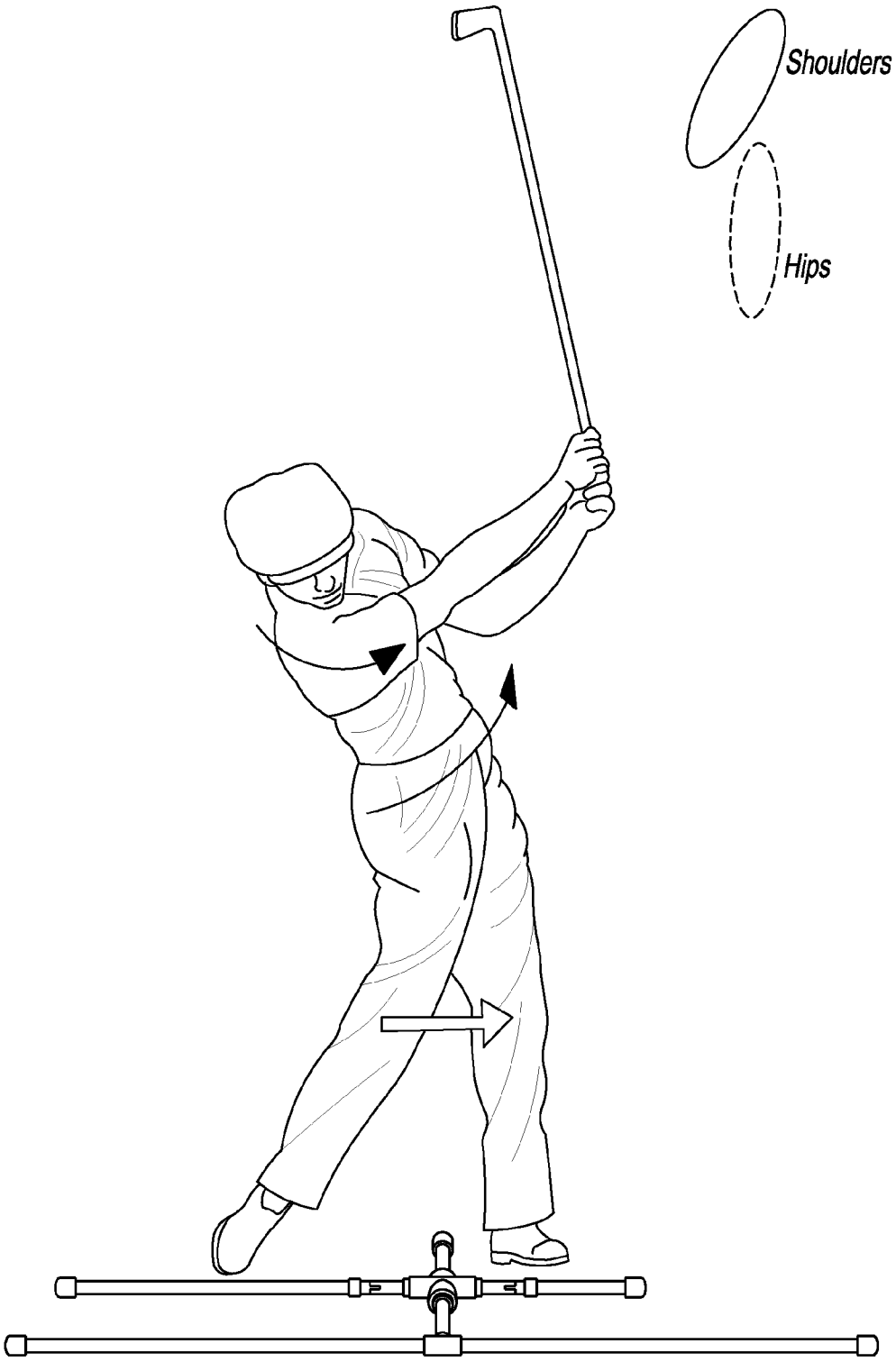
FIG. 17 is a frontal environmental view showing the turning of the hips after impact, and the movement of the shoulders and the right knee through the impact area, en route to a high finish.
Figure 18:
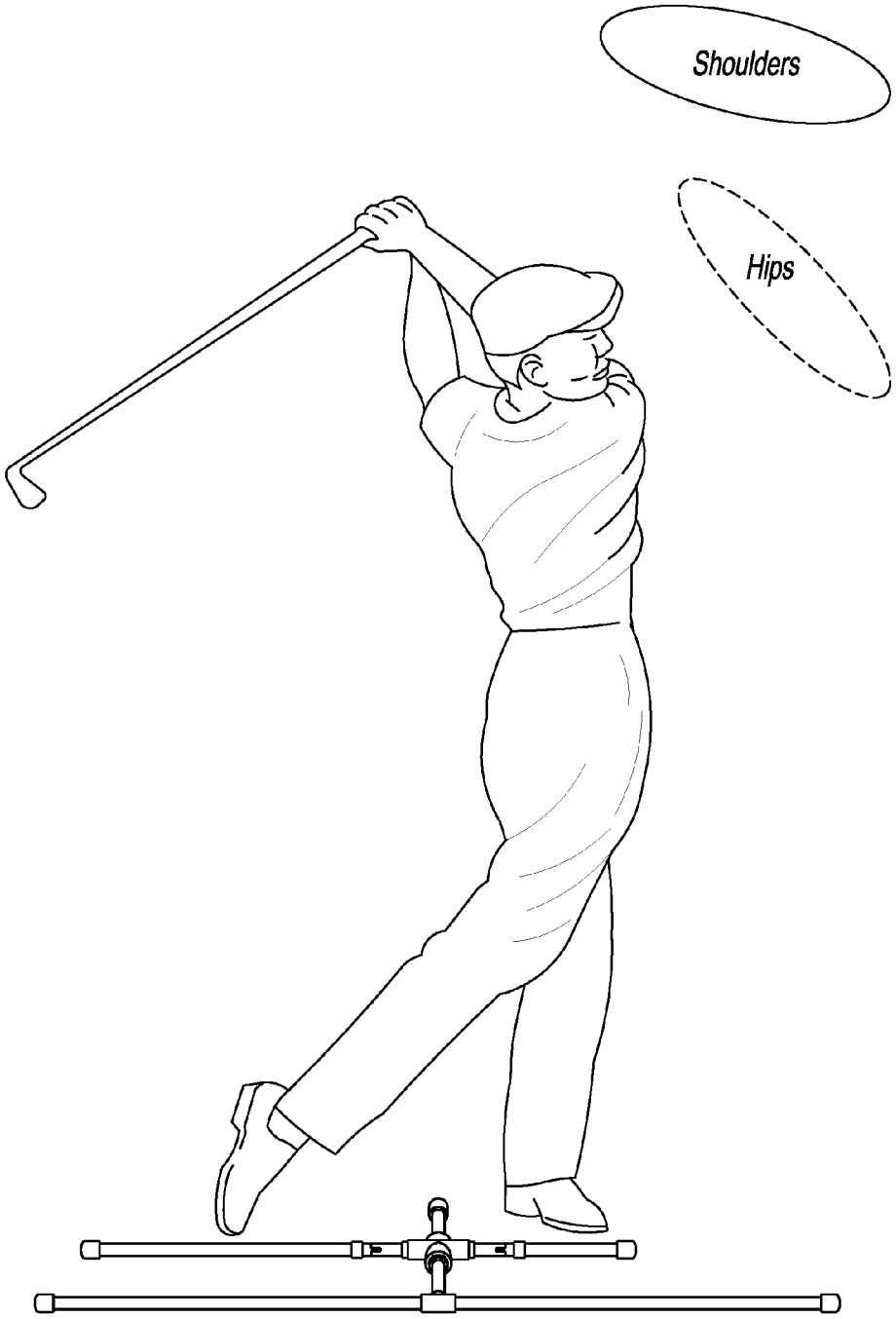
FIG. 18 is a frontal environmental view showing a classic Hogan pose, with the user's belt buckle facing to the left of the target line, and the user's hands finishing high at the end of the swing.

As discussed above, the hands move back over the position "A" bar (5) during the downswing to square the clubface. It is possible on most shots to start the downswing by moving the hands over the position "A" bar (5), including either the forward or the rearward extension (7 and 6 respectively), because either the entire position "A" bar (5), the forward extension (7), or the rearward extension (6), is extended parallel to the target line. The spine angle alignment guide (3), plays a role during the downswing. The spine angle alignment guide (3) may also be brightly colored, as the downswing occurs so quickly, a bright color may help to catch the user's eye. As shown in FIGS. 15, 16 and 17, during the downswing, the player should turn around the spine angle (23). At impact the head and spine angle (23) should remain behind the ball as the rotation of the hips, shoulders, forearms, and release of the wrists cause the clubhead to strike the back of the ball (17), sending it airborne. If the spine angle alignment guide (3) is brightly colored, the user would quickly learn to turn, back and through, without encroaching it, and would more easily know when encroachment has occurred. Also, the right knee should move toward the target during the downswing, as this helps to transfer weight back to the left side, and to square the shoulders at impact. The phrase "coming over the top" is frequently used to describe what happens when the right shoulder looks left of the target line (25) during impact. When this occurs the spine angle (23) encroaches the spine angle alignment guide (3) during the downswing, generally resulting in a hooked or pulled shot. Of course, after impact, the spine angle (23) and torso may move toward the target, en route to a high finish as shown in FIG. 18.

Figure 8:
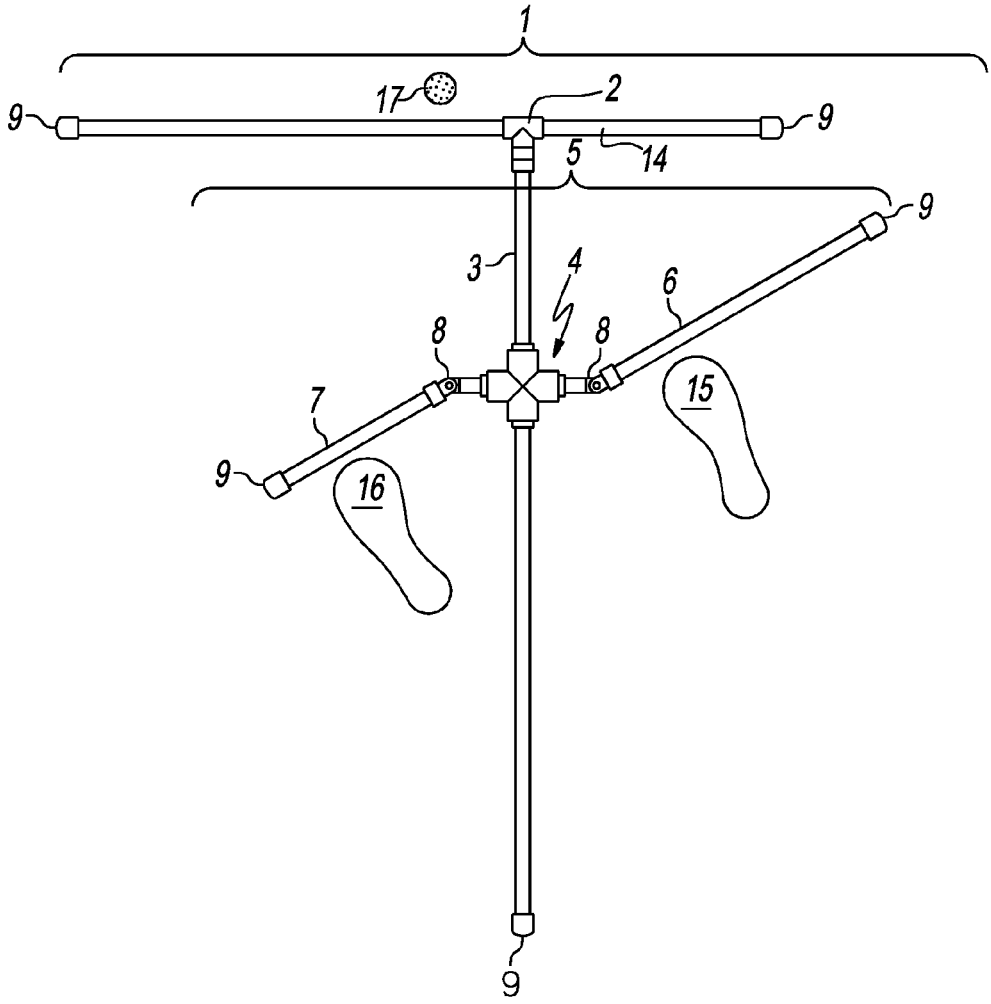
FIG. 8 is a top environmental view showing exemplary positioning of the takeaway bar, and of the forward and rearward extensions of the position "A" bar when hitting a sand shot, with the ball positioned up in the stance.

There may be some confusion in regard to the positioning of the ball in the stance. The takeaway bar (1) comprises a ball placement guide (2). The ball placement guide (2) indicates where the ball should be positioned for all standard shots, as this is the position where the clubface will square with the proper trajectory. However, a standard trajectory is not always desired, and the ball may not always be sitting up in the grass. So when playing a delicate chip shot from a grassy lie, for example, it may be best to put the ball back in the stance (and to perhaps use a more lofted club) so that the clubface contacts the ball before being caught up in the grass. The same technique may be used when hitting from hard pan because the clubhead will not be able to scoot under the ball. In such cases, it is important to hit the ball first. Conversely, the opposite may be true when hitting a bunker shot. The ball should be positioned well up in the stance so that the clubhead can scoot under the sand to "pop" the ball out. FIG. 8 shows how the golf swing aid apparatus may assist with the bunker shot. Regardless of where the ball is positioned in the stance for these specialty shots, however, the swing axis (24) and swing plane should remain essentially the same. The reason for this is that at address, the user's spine angle (23) should be positioned opposite the spine angle alignment guide (3), the shoulders are positioned parallel left of the target line (25), the clubhead moves straight back from the ball (17) along the takeaway bar (1), and the swing axis (24) should be measured from a point behind the ball placement guide (2), and extending upward through the top of the left shoulder (for a right handed player). Consequently, the swing plane does not change in any significant way.

The swing aid may be used to teach the user how to "work the ball" (1). The term "working the ball" as used herein means that the ball (17) may start along the target line (25), and the curve to the left or right. A "draw" is where the ball (17) starts along, or right of, the target line (25) and then curves to the left. A "fade" is where the ball (17) starts along, or left of, the target line (25), and then curves to the right. Furthermore, the ball (17) may be played up or back in the stance when playing a draw or a fade (see, FIGS. 22A through 25). To assist the user in working the ball (17) the hands placement guide (4), and the ball placement guide (2) may be fitted with a decal conveying instructions on how to hit a straight shot, a fade, or a draw. To hit a draw, the ball (17) may be positioned up in the stance, a bit left of the center of the ball placement guide (2), this will cause the clubface angle (22) to align slightly to the left of the target line (25), and the ball will move in that direction. To hit a fade, the ball (17) may be positioned back in the stance, a bit right of center of the ball placement guide (2), this will cause the clubface angle (22) to align slightly to the right of the target line (25), and the ball will move in that direction.

Additionally, the ball (17) may be worked by changing the shaft angle (21) without changing the ball (17) position. But first, and referring to FIG. 23, to hit a straight shot, the shaft angle (21) should be aligned along the swing axis (24) as described above. The clubface angle (22) will be squared to the target line, and there should be little to no curvature in the flight of the ball. To hit a fade, position the hands over the hands placement guide (4), as is customary (see, FIG. 11), but align the shaft angle (21) slightly left of the swing axis (24). This will cause clubface angle (22) to look a bit to the right at address and at impact, and the wrists to rotate a bit less sharply through the impact zone, causing the ball to move to the right. The hit a draw, position the hands over the hands placement guide (4), as is customary, but align the shaft angle (21) slightly left of the swing axis (24). This will cause clubface angle (22) to look a bit to the left at address and at impact, and the wrists to rotate a bit more sharply through the impact zone, causing the ball to move to the left. When working the ball, the user must remember that the swing plane does not change, only the clubface angle (22) through the impact zone, and the nature and direction of the spin imparted on ball (17) on account of the directional rotation of the wrists. Consequently, it is indispensable that the user executes the downswing with the hips, moving the hands over the position "A" bar, to impart spin and curvature on the ball (17).

Finally, the present swing aid may be used to improve the putting stroke. Using the putter is different from using any other club; however, slight adjustments may be made to make the apparatus suitable for practicing putting. FIG. 21 is a top environmental view showing the utility of the apparatus in regard to putting with the putting hands placement guide (4*a*). The putting hands placement guide (4*a*) attaches to the spine alignment guide (3) and provides a visual reference for the user when the user positions his or her hands in the set up. When using the apparatus to practice putting, the position "A" bar (5) should be pushed toward the takeaway bar (1), as shown in FIG. 21. Also, the apparatus should be positioned on the putting surface with the takeaway bar (1), parallel left of the ball line. The ball line is the initial direction in which the ball (17) will roll. The contour of the green will then take the ball (17) accordingly, or to "break." When setting up to putt, the shoulders should be parallel left of the takeaway bar (1), with the ball (17) positioned about 4 inches across from the ball placement guide (2), and across from the left heel of the left foot placement (16). The putting grip should be neutral with the palms facing each other to help avoid pulling, which is where the ball rolls left of the ball line, and the right hand grip in the fingers to keep the clubface square. The user should then bend from the hips, with virtually no left to right angling of the spine angle (23), and place the head of the putter behind the ball. It is very important that the shoulders are level to start back on the ideal straight back and through stoke path. In the exemplary position, the user's hands are positioned over the putting hands placement guide (4*a*) that is located under the shoulders, and essentially in the center of the stance. Furthermore, the shaft angle (21) of the putter should be aligned at the spine angle (23) at address. This will enable the hands, putterhead, and shoulders to square simultaneously through the impact zone, which tends to eliminate side spin and leads to a truer roll. The putting hands placement guide (4*a*), may be made detachable and adjustable, and fitted with a decal to convey useful information to the user. FIG. 21 also depicts the directional movement of the putterhead during the stroke. At address, the position of the hands, arms, and shoulders form a "triangle" (as in the full swing), which should be maintained throughout the stroke. Additionally, the seat (or rear) should be kept up, to help establish the tilt angle of the torso, and to help stabilize it during the stroke. The stroke should be executed (with the putterhead moving straight back and through as depicted in FIG. 21) with the shoulders alone, striving to eliminate all independent hand movement, and keeping the left wrist firm through impact. The user's head should be kept still throughout the stroke to maintain good aim. By employing these steps while using the apparatus, the user will become a better putter.

Also disclosed is a method of using a golf training aid with comprising steps of positioning a golf training aid comprising a longitudinal spine alignment guide, a takeaway bar connected transverse to the spine alignment guide, a position "A" bar positionable along the longitudinal spine alignment guide corresponding to a shaft length of a golf club, and a ball placement guide, where the position "A" bar is movable toward and away from the takeaway bar. Then, aligning the takeaway bar along a target line, the target line between a golf ball and a golf target, placing a ball in front of the ball placement guide, adjusting the position "A" bar toward or away from the takeaway bar according to the shaft length of the golf club, and hitting the golf ball by swinging the golf club, the path of the golf club being along the takeaway bar during a portion of the swing. The method may include extending the takeaway bar toward the golf target corresponding to the shaft length of the golf club. Additionally, the method may include aligning the hands over a hands placement guide on the position "A" bar.

In various embodiments, the golf aid includes the position "A" bar having a rearward extension pivotable toward and away from the takeaway bar, and a forward extension pivotable toward and away from the takeaway bar, and the method includes the step of adjusting the position "A" bar further comprising pivoting the forward extension away from the takeaway bar a distance corresponding to the shaft length of the golf club, and pivoting the rearward extension toward the takeaway bar a distance corresponding to the shaft length of the golf club.

Alternatively, where the position "A" bar comprises a rearward extension pivotable toward and away from the takeaway bar, the method may include the step of adjusting the position "A" bar further comprising pivoting the rearward extension away from the takeaway bar a distance corresponding to the shaft length of the golf club.

In yet another alternative, where the position "A" bar comprises a forward extension pivotable toward and away from the takeaway bar, the method may include the step of adjusting the position "A" bar further comprising pivoting the forward extension away from the takeaway bar a distance corresponding to the shaft length of the golf club.

Although the principles and operation of the present invention have been described in detail herein, this is not to be construed as being limited to the particular illustrative forms disclosed herein. It will thus become apparent to those skilled in the art that various modifications and embodiments can be made without departing from the spirit or scope of the invention as defined by the appended claims.

What is claimed is:

1. A golf training aid for use with a golf club having a shaft length comprising:

a longitudinal spine alignment guide;

a straight takeaway bar extended to form a swing plane, comprising a ball placement guide, and connected transverse to the spine alignment guide wherein the spine alignment guide is adjustable at a hands placement guide identifying hand placement during set up of a golf swing; and a position "A" bar positionable along the longitudinal spine alignment guide, where the position "A" bar is movable toward and away from the takeaway bar, the position "A" bar comprises a stance mechanism for independent adjustment of the left and right foot placement, and the position "A" bar has a hands placement guide comprising a graphic for positioning a shaft angle at address.

2. The golf training aid according to claim 1, where the takeaway bar is connected adjacent to an end of the spine alignment guide.

3. The golf training aid according to claim 1, where the takeaway bar has an elongated bar member positionable relative to the ball placement guide adjustable along the transverse direction.

4. The golf training aid according to claim 1, wherein the position "A" bar is adjustable corresponding to the shaft length of the golf club.

5. The golf training aid according to claim 1, where the position "A" bar further comprises:

a rearward extension pivotable toward and away from the takeaway bar, and a forward extension pivotable toward and away from the takeaway bar.

6. The golf training aid according to claim 1, where the aid comprises a polymeric material.

7. The golf training aid according to claim 6, where the polymeric material is polyvinyl chloride.

8. The golf training aid according to claim 6, where the polymeric material is polyethylene.

9. The golf training aid according to claim 1, where the ball placement guide and the hands placement guide provide instructions for hitting a draw or a fade.

10. The golf training aid according to claim 1, further comprising a brightly colored external surface.

11. The golf training aid according to claim 1, further comprising a detachable hand placement guide identifying hand placement while putting.

12. The golf training aid according to claim 1, wherein the aid comprises a graphite material.

13. A method of using a golf training aid comprising:

positioning a golf training aid comprising a longitudinal spine alignment guide, a straight takeaway bar extended to form a swing plane and connected transverse to the spine alignment guide wherein the spine alignment guide is adjustable at a hands placement guide identifying hand placement during set up of a golf swing, a position "A" bar positionable along the longitudinal spine alignment guide corresponding to a shaft length of a golf club wherein the position "A" bar has a stance mechanism for independent adjustment of a left and a right foot placement and the hands placement guide for proper hand and shaft angle placement at address, and a ball placement guide, where the stance mechanism of the position "A" bar further comprises at least one of a rearward extension pivotable toward and away from the takeaway bar, and a forward extension pivotable toward and away from the takeaway bar, aligning the takeaway bar along a target line, the target line between a golf ball and a golf target, placing a ball in front of the ball placement guide, adjusting the stance mechanism of the position "A" bar toward or away from the takeaway bar by pivoting the one of the rearward extension and the forward extension a distance corresponding to the shaft length of the golf club, hitting the golf ball by swinging the golf club, the path of the golf club being along the takeaway bar during a portion of the swing.

14. The method of using a golf training aid according to claim 13 further comprising:

extending the takeaway bar toward the golf target corresponding to the shaft length of the golf club.

15. The method of using a golf training aid according to claim 13 further comprising:

aligning the hands over the hands placement guide on the position "A" bar.

* * * * *